United States Patent [19]

Silberman et al.

[11] 4,373,584

[45] Feb. 15, 1983

[54] SINGLE TRIP TUBING HANGER ASSEMBLY

[75] Inventors: Raphael J. Silberman, Houston, Tex.; Frederick T. Tilton, La Habra, Calif.; Everett H. Smith, Houston; Dennis A. Wichkoski, Pasadena, both of Tex.

[73] Assignee: Baker International Corporation, Orange, Calif.

[21] Appl. No.: 36,964

[22] Filed: May 7, 1979

[51] Int. Cl.[3] ..... E21B 19/00

[52] U.S. Cl. ..... 166/117.7; 166/313; 166/382; 166/189; 166/212

[58] Field of Search ..... 166/313, 117.7, 315, 166/238, 189, 239, 208, 154, 212, 321, 237, 322; 285/2, 3, 4, 18, 23, 31; 403/2, 3, 12; 64/23, 27 R

[56] References Cited

U.S. PATENT DOCUMENTS

| | | | |
|---|---|---|---|
| 2,994,280 | 8/1961 | Daffin | 285/2 |
| 3,603,401 | 9/1971 | Nelson et al. | 166/313 |
| 3,851,714 | 12/1974 | Jisser et al. | 173/164 |
| 4,098,334 | 7/1978 | Crowe | 166/208 |
| 4,143,712 | 3/1979 | James et al. | 166/313 |

*Primary Examiner*—William F. Pate, III
*Attorney, Agent, or Firm*—William C. Norvell, Jr.

[57] ABSTRACT

An apparatus is provided for producing a well from at least one productive zone penetrated by the well bore in which casing is set below the top of the well. Tubing hanger means support at least one production tubing string extending downwardly in the well bore and communicating with a production zone. Anchor means on the tubing hanger means are actuatable into anchoring engagement with the casing. The tubing hanger means receives at least one upper production tubing string section typically carrying safety valve means thereon extending to the top of the well and sealingly engageable with the tubing hanger means before, during and after the anchoring engagement of the tubing hanger means with the casing, whereby the upper production tubing string section is respectively communicable with the downwardly extending production tubing string when the tubing hanger is set. A latch apparatus is carried on and extending between the upper production tubing string sections for initial securement of the tubing hanger means to each of the upper production tubing string sections, the latch apparatus carrying the sum of the strength of the tubing hanger means and each of the lower production tubing string sections. Anchoring of the tubing hanger and sealing engagement therein of the production tubing string section may be effected in one trip down the well, without the requirement of retrieval of a work string or other means used to set the hanger, and without subsequent re-entry into the well of the upper production tubing string section carrying the safety valve means for sealing engagement into the hanger means.

65 Claims, 40 Drawing Figures

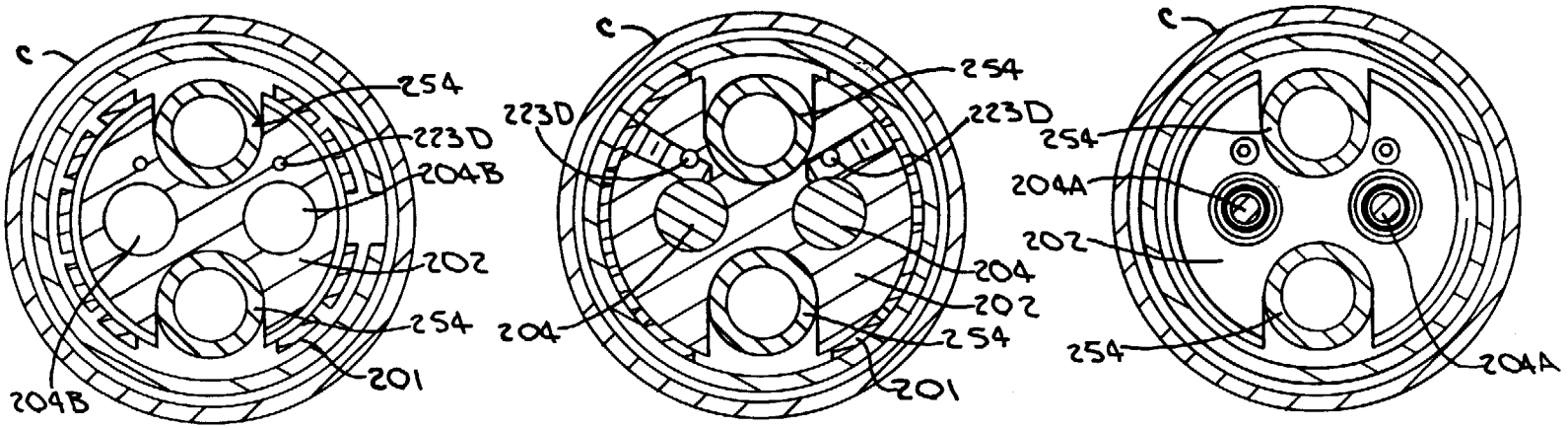
FIG.19A
FIG.19B
FIG.19C
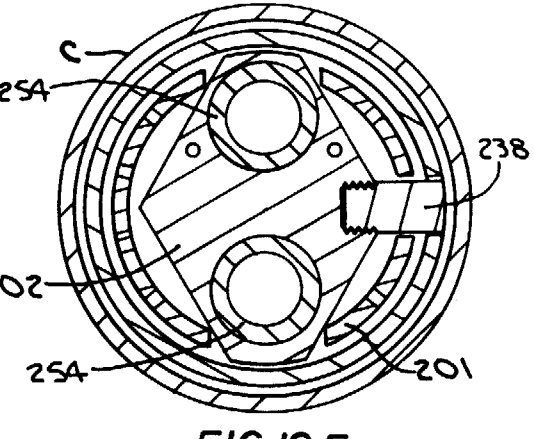
FIG.19D
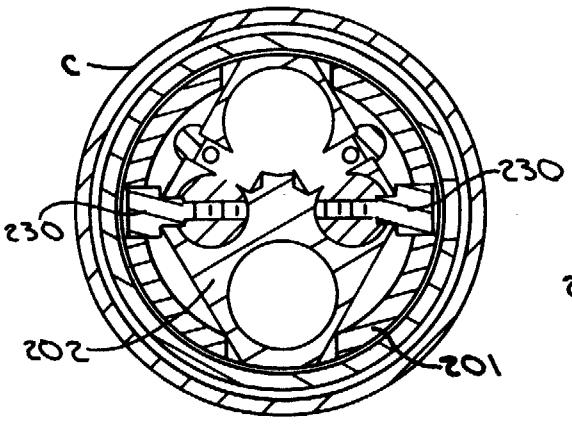
FIG.19E
FIG.19F

SINGLE TRIP TUBING HANGER ASSEMBLY

CROSS-REFERENCE TO RELATED APPLICATIONS

This application is related in subject matter to co-pending applications: Ser. No. 036,963, filed May 7, 1979, entitled "Method And Apparatus For Rotating Tubing Conduits", now U.S. Pat. No. 4,239,083, issued Dec. 16, 1980; Ser. No. 36,908, filed May 7, 1979, entitled "Latch Assembly And Method", now U.S. Pat. No. 4,248,307, issued Feb. 3, 1981; Ser. No. 36,909, filed May 7, 1979, entitled "Control Tool", now U.S. Pat. No. 4,252,196, issued Feb. 24, 1981; and Ser. No. 36,910, filed May 7, 1979, entitled "Method And Apparatus For Carrying First And Second Weight Loads Of A Tubing String", each of said co-pending applications being assigned to the same assignee as the present application.

BACKGROUND OF THE INVENTION

1. Field of the Invention

The invention relates to a method and apparatus for the running and setting of, and to the unlatching from and relatching to, a tubing hanger assembly in a subterranean well, the hanger when in anchored position carrying the weight load of production tubing extending therebelow and receiving through its uppermost end production tubing extending thereabove to the surface of the well. The tubing extending from the surface of the well normally will carry one or more safety valves and is run in the well together with the tubing hanger assembly and the tubing extended therebelow. The hanger may be run and anchored in the well on and with the upper tubing containing the safety valves in one trip.

2. Description of the Prior Art

In the production of well fluids, such as oil and/or gas, from wells, it has been the practice to provide automatically closeable shut-off or safety valves which are located downhole in the well and are held open by control fluid pressure, the valves closing automatically when control fluid pressure is purposely reduced to allow the valves to close or damage occurs to the control fluid system at the well head or on an offshore platform. Such valves are employed below the well head, and in the case of offshore wells, the valves are installed below the mud line at such depth as may be desired or established by regulation, so that in the event of damage of the well caused by shifting earth or subsidence, or well head catastrophe, the well can be shut in to avoid loss of valuable well fluids into the water, and also, to avoid contamination of the water and the shore.

Many offshore wells are produced from spaced well zones through separate strings of production tubing, and a safety or shut-off valve is required for each zone. Since, from time-to-time, it is necessary to perform various remedial operations through the tubing strings, it is preferred that the safety valves be easily removed from the well for service or repair. Accordingly, commercially available safety or shut-off valves have been provided which have been run into the well casing on production tubing and landed in a tubing hanger which supports the greater weight of the downwardly extending production tubing strings. Typically, such a tubing hanger has been run into the well casing on a setting tool to a desired location, and, in the case of an offshore well, to a prescribed depth below the mud line. In such an apparatus, the tubing hanger is anchored in the well casing and the setting tool is released from the tubing hanger and removed from the well. The tubing hanger provides a seat for the safety or shut-off valve assembly which is run into the well on an upward extension of the production tubing and landed in the tubing hanger, subsequent to the setting of the hanger and retrieval of the hanger setting tool.

Typical of such prior art apparatuses is that as disclosed in U.S. Pat. No. 3,771,603, issued Nov. 13, 1973, entitled "Dual Safety Valve Method And Apparatus", to Talmadge L. Crowe, the disclosure of which is hereby incorporated herein by reference. The necessity of two trips into the hole with work strings and/or other means to first carry and anchoringly set the tubing hanger and thereafter land the conduits containing the safety valves therein is an economic deterrent since considerable rig time is expended in running a first work string and/or other means for anchoring the hanger, retrieving the work string and/or other means, and thereafter running the production tubing containing the safety valve or valves into sealing engagement with the hanger.

The present invention obviates many of the problems typified by prior art, commercially available apparatuses, and is an improvement thereto by providing means for setting of the tubing hanger and sealing engagement of the production tubing containing the safety valve or valves in only one trip, thus eliminating the need for costly retrieval of the initial setting work string and/or other means and thereafter running into the well the production tubing containing the safety valves for sealing engagement with the tubing hanger.

Although the present invention finds particular adaptability for use in multi-zone completions, wherein two or more production tubing strings extend from the top of the well through the tubing hanger apparatus, it is easily adaptable for use with only one production tubing string in a completion of a well containing only a single production zone.

When the invention is utilized in conjunction with multiproduction tubing strings, it is particularly unique inasmuch as a single latch assembly may be utilized, as described below, in one embodiment, to engage the upper tubing string section extending from the surface of the well into sealing engagement with the tubing hanger. Hertofore, some prior art apparatuses have utilized dual latch assemblies. The provision of a single latch assembly is particularly beneficial because it can carry substantially the complete weight of the production tubing therebelow and thus can accomplish whatever the weight load strength of the production tubing therebelow can accomplish, thus enabling the tubing hanger to carry the load that is equal to the strength of the dual production tubing strings. This ability also is made possible by utilization of a unique shear-out safety joint apparatus which provides a means of separating the tubing conduit above the safety valve means when a predetermined load across the shear-out safety joint is exceeded, and also provides a bridge so that a weight load up to the full production tubing strength initially can be carried for a preliminary operation. such as the setting of a packer apparatus below the hanger assembly. Thereafter, the bridge may be removed and the load capability of the shear-out safety joint apparatus is relaxed.

The tubing hanger apparatus incorporates means for hydraulically releasing the latch assembly for retrieval of the production tubing string extending to the top of the well which has been initially sealingly landed within the tubing hanger. The latch assembly also has auxiliary mechanical disengaging means which may be activated in the event of failure of the latch assembly to disengage from the tubing hanger by hydraulic means.

In an alternative embodiment, the latch assembly also incorporates hydraulic means for setting of the tubing hanger to anchor the hanger to the well casing. Thus, the tubing hanger may be set hydraulically without the use of a wireline activated or other separate setting tool.

Each component part of the tubing hanger assembly is designed with rotational torque capability to accommodate the mechanical release backup feature of the latch apparatus.

The single trip tubing hanger assembly of the present invention also enables the pulling and repair of the tubing strings sealingly latched in the tubing hanger to seal failure, nipple damage, or the like, without the retrieval of the entire string of production tubing, the string of production tubing below the tubing hanger remaining in the well after retrieval of the production tubing section extending from the top of the well and initially sealingly engaged within the tubing hanger and carrying the safety valve means. The retrieval of the production tubing extending from the top of the well to the tubing hanger (hereinafter sometimes referred to as the "space-out section") may be accomplished by use of only a small crane, as opposed to the prior art utilization of a large drilling rig, or the like.

The mechanical release backup feature of the latch assembly alternatively incorporates a swivel sub apparatus which permits rotation of the section of production tubing immediately above the tubing hanger when the space-out section is secured against rotation into the surface hanger at the top of the well, or fixed by its position in the space-out assembly.

SUMMARY OF THE INVENTION

The present invention provides an assembly for the production of a subterranean well from at least one productive zone which is penetrated by a well bore in which casing is set below the top of the well. The assembly has tubing hanger means which support at least one production tubing string extending downwardly in the well bore and respectively communicating with one productive zone. Anchor means are carried on the tubing hanger means and are activatable into anchoring engagement with the interior wall of the casing. The hanger means receives at least one upper production tubing string section which extends to the top of the well and is sealingly engageable within the tubing hanger means before, during and after the anchoring engagement of the tubing hanger means with the casing, whereby the upper production tubing string section is respectively communicable with the downwardly extending production tubing string when the tubing hanger is set for production of the well. Typically, the upper production tubing string section will contain safety valve means, manipulated between open and closed positions through control fluid extending within conduit means leading from the safety valve means to the top of the well and connectable to a source of control fluid pressure.

One or more of the upper production tubing string sections may contain a selectively separatable shear-out safety joint whereby the tubing string may be parted therebelow. The shear-out safety joint used within the present one trip tubing hanger assembly comprises first means selectively retrievable from the shear-out safety joint for carrying across said shear-out joint a first weight load defined through the production tubing string below the shear-out safety joint, and second weight load carrying means for carrying across the shear-out safety joint a second weight load defined through the tubing string below the shear-out safety joint, the second weight load being less than the first weight load, the second means being activatable to separate the shear-out safety joint and the tubing string therebelow when the second weight load is exceeded.

To assist in effecting an auxiliary backup mechanical unlatching feature incorporated in one aspect of the one trip hanger assembly, a swivel sub apparatus may be carriable on one or more of the upper production tubing string sections. The swivel sub apparatus is manipulatable to rotate the lower tubing section therebelow without rotating the upper tubing section thereabove, and comprises first and second housings, one of the housings and the lower tubing section being rotatable relative to the other of the housings. The swivel sub apparatus also contains actuator means insertable within at least one of the housings for applying rotation to one of the housings. Co-engaging means are carried on the actuator means in one of the housings for applying rotational force to one of the housings and the lower tubing section to rotate the one housing and the lower tubing section without rotating the other housing and the upper tubing section.

The tubing hanger incorporates a unique latch assembly comprising an outer housing and an inner body, the latch assembly carrying the sum of the strength of the tubing hanger means and each of the lower production tubing string sections. Latching means are carried on one of the housing and the body for selectively securing the apparatus to the tubing hanger means. Latching engaging means are carried on the other of the housing and the body and the tubing hanger means for selective co-engagement of the latching means between the tubing hanger means and one of the housing and the body. Piston means are defined on one of the housing and the body having a shiftable piston head. First and second piston chambers are defined between the piston head, with control means, removable from the latch apparatus for directing fluid pressure transmitted through the space-out section to one of the chambers. Passageways selectively provide a first fluid flow path within the control means and the latch apparatus to one of the upper and lower piston chambers to shift the housing and the body relative to one another to release the latching means from the tubing hanger. The control means also has passageways selectively providing a second fluid flow path therethrough to the other of the upper and lower piston chambers to shift the housing and the body relative to one another to engage the latching means to the tubing hanger.

BRIEF DESCRIPTION OF THE DRAWINGS

FIG. 19A is a cross-sectional view taken along line 19A—19A of FIG. 16.

FIG. 19B is a cross-sectional view taken along line 19B—19B of FIG. 16.

FIG. 19C is a cross-sectional view taken along line 19C—19C of FIG. 16.

FIG. 19D is a cross-sectional view taken along line 19D—19D of FIG. 16.

FIG. 19E is a cross-sectional view taken along line 19E—19E of FIG. 16.

FIG. 19F is a cross-sectional view taken along line 19F—19F of FIG. 16.

FIGS. 5A, 5B, 5C, 6, 8A, 8B, 8C, 9A, 9B, 16 and 17 are all views looking into 90° planes.

DESCRIPTION OF THE PREFERRED EMBODIMENTS

Figure 1:
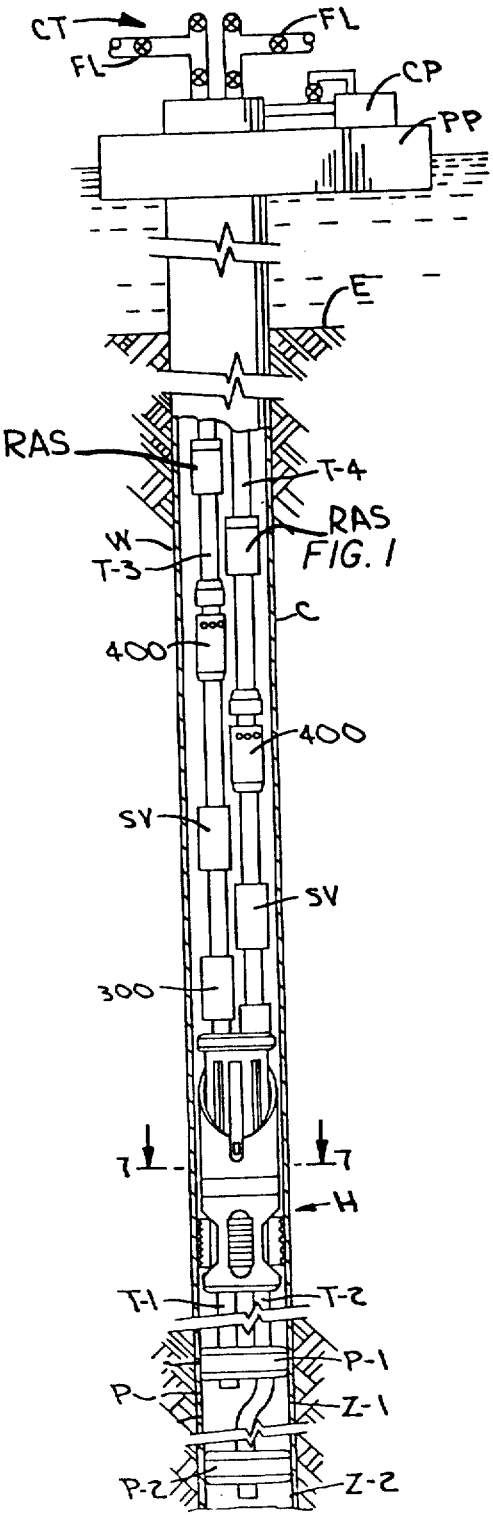
FIG. 1 is a diagrammatic illustration showing the single trip tubing hanger assembly installed in a well casing extending through vertically spaced productive well zones which are isolated from one another by packers, and from which well fluids are produced through a pair of production tubing strings.

Referring now to FIG. 1, a well bore W extends downwardly into the earth below the ocean floor F through vertically spaced well fluid producing zones Z-1 and Z-2. A casing C is set in the well bore and perforations P in the casing establish communication between the production zones Z-1 and Z-2 and the casing C. Set in the casing C is an upper packer P-1 located above the production zone Z-l and a lower packer P-2 located in the casing between the production zones Z-1 and Z-2. A first production tubing string T-1 extends from a tubing hanger H through the packer P-1 and opens into the casing therebelow to communicate with the production zone Z-1, and a second production tubing T-2 extends downwardly from the tubing hanger H through the upper packer P-1 and downwardly through the lower packer P-2 into the casing therebelow for communication with the production zone Z-2. The tubing strings T-1 and T-2 may extend a number of thousands of feet downwardly in the casing C to the packers P-1 and P-2, and the tubing strings T-1 and T-2 are supported by the tubing hanger assembly H which is set or anchored in the well casing and forms a seat for plural safety valves SV for the respective tubing strings T-1 and T-2. The hanger assembly H and the valve assemblies SV are located below the ocean floor F or the mud line of a body of water, at a desired or required depth of about 500 to 1,000 feet, more or less. The casing C extends upwardly through the water to a production platform or barge PP. However, as is well known, the well may be completed at the ocean floor and one or a number of additional casings (not shown) may be set in larger diameter well bores, and the casing C may be suspended or hung from a casing hanger located at the ocean floor, in which case a conductor pipe or other casing (not shown) may extend to the production platform PP. In any event, upper production fluid tubings T-3 and T-4 extend upwardly from the hanger assembly H and are connected with christmas trees CT on the platform PP whereby the flow of well fluids from the well zone Z-1 and Z-2 may be controlled or manually shut off. Flow lines FL are provided to conduct well fluids from the christmas trees CT to suitable reservoirs or tanks (not shown).

The respective subsurface safety valves SV, which are normally closed, are adapted to be held open, to enable the flow of production fluids therethrough, by means of control fluid pressure supplied through a control fluid conduit (not shown), or through a pair of such conduits, from a source of control fluid pressure at a control panel CP on the platform PP. So long as the control fluid pressure is adequate to maintain the subsurface valves SV open, well fluids may flow from the zone Z-1 and Z-2 to the respective flow lines FL, but, if it is desired for any reason to close either of the shut-off valves SV, or in the event of damage of the control fluid tubing, the control fluid pressure may be varied so that the subsurface valves SV are automatically closed, thereby shutting the well in at a location below the ocean floor, to prevent continued production fluid flow.

The valve assemblies SV may be retrieved from the tubing hanger apparatus H so that under circumstances requiring repair or service of the valves SV, it is not necessary to pull the production tubing strings T-1 and T-2. Since only the comparatively short upper production tubing strings T-3 and T-4 need be pulled, selectively, or together, from the well to remove one or more of the valves SV, and the substantially longer production tubing strings T-1 and T-2 remain in the well, the platform PP need not be equipped with or supplied with high-powered hoisting apparatuses. Instead, the platform PP may simply be provided with a small relatively low-powered hoist mechanism or a gin pole hoist. In addition, the tubing strings T-1 and T-2 may be plugged off at or below the hanger H with bypass plugs in sealing nipples to enable the service or repair of the safety valves SV, without requiring that the well be killed.

Figure 2:
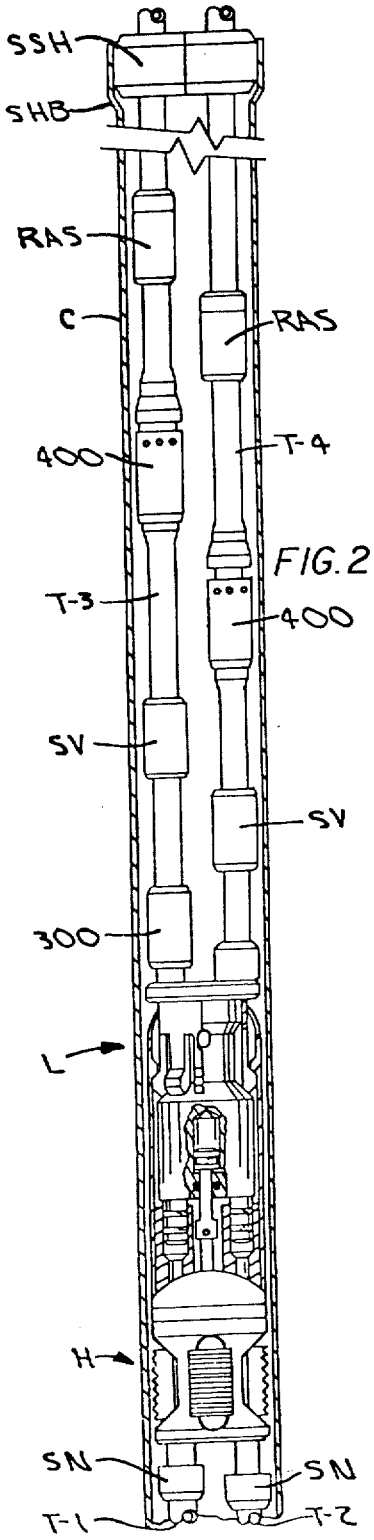
FIG. 2 is a schematic illustration similar to that shown in FIG. 1, with a lower view of the interior of the tubing hanger prior to setting of the tubing hanger to the casing.
Figure 3:
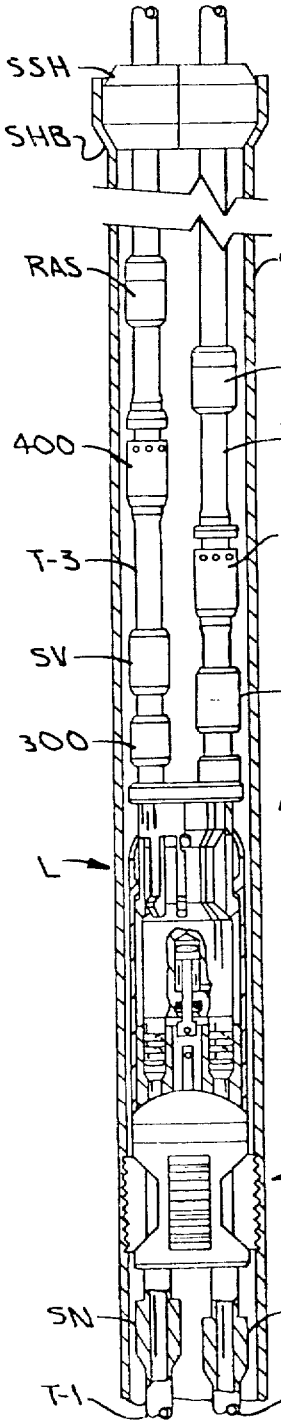
FIG. 3 is a schematic view similar to that of FIG. 2, showing the tubing hanger anchoringly engaged to the casing subsequent to activation of the hanger setting means carried within the latch assembly.
Figure 4:
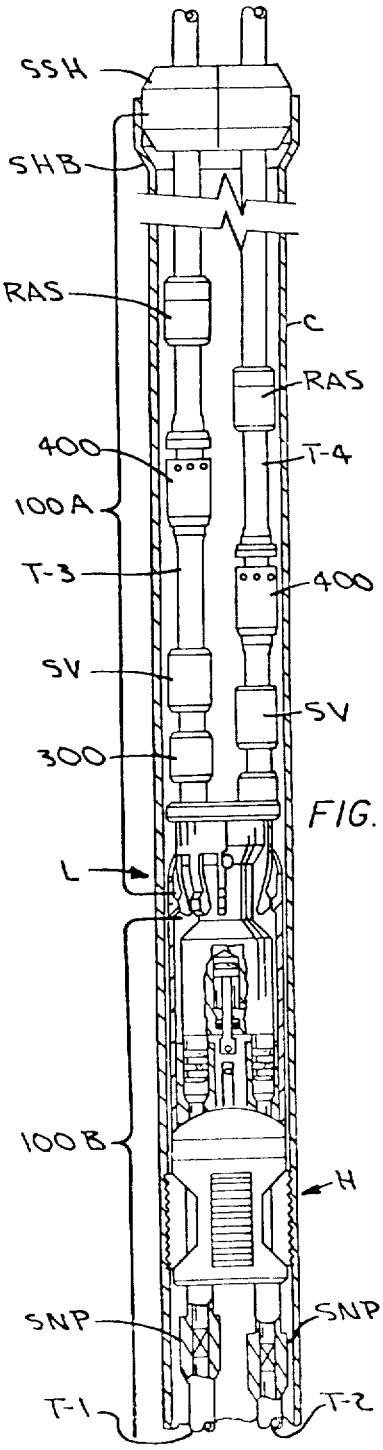
FIG. 4 is a schematic view illustrating the unlatching or relatching of the space-out section to the tubing hanger.

As also shown in FIGS. 2, 3 and 4, the tubing strings T-3 and T-4 are sealingly engaged within the split surface hanger SSH below the christmas tree CT and adaptable to be landed within the casing C in a profile or surface hanger bowl SHB subsequent to anchoring engagement of the hanger assembly H. The split surface hanger SSH is utilized to suspend the tubing weight from the tubing head on the platform PP and the surface hanger bowl SHB carries the tubing weight above the tubing hanger H when the split surface hanger SSH is in position within the bowl SHB.

One or both of the tubing strings T-3 and T-4 may carry rotational adjustment subs RAS somewhat below the split surface hanger SSH in order to space out the tubing strings T-3 and T-4 from the surface hanger SSH to the tubing hanger H to permit extension or contraction of the tubing length prior to setting of the hanger H. As an alternative to utilization of a rotational adjustment sub RAS, a conventional slip joint may be incorporated into one or both of the strings T-3 and T-4.

Below the rotational adjustment subs RAS on each of the strings T-3 and T-4 is defined a shear-out safety joint 400 which is utilized to part the respective tubing string T-3 and T-4 above the safety valves SV for retrieval to the top of the well W in the event of a disaster. The shear-out safety joints 400 automatically separate when the weight load strength of the tubing string is exceeded, or other predetermined load carried therethrough.

Below the shear-out safety joints 400, and at a depth below the ocean or other floor F, are conventional tubing mounted or wireline safety valves SV carried on each of the tubing strings T-3 and T-4. The utilization of any particular tubing mounted or wireline safety valves is not critical to the present invention. The safety valves SV utilized with the present invention may be those as described in detail in U.S. Pat. No. 3,771,603.

One or more of the tubing strings T-3 and T-4 may carry optional swivel subs 300 spaced thereon and below the safety valves SV as an alternate means to mechanically disengage the latch L from the tubing hanger H.

Below the swivel subs 300 is the tubing hanger H which is provided to anchor against the interior wall of the casing C and thereafter carry the weight of the tubing strings T-1 and T-2 therebelow. Seating nipples SN are carried on the tubing strings T-1 and T-2 below the tubing hanger H and are provided with a seal bores for receipt of plugging means SNP (FIG. 4) which are landed therein by wireline prior to unlatching of the latch L from the tubing hanger H or, prior to the setting of the tubing hanger H.

Thus, it can be seen that the tubing hanger assembly 100 generally comprises an upper space-out section 100A, consisting of tubing strings T-3 and T-4 and component parts carried thereon, a tubing hanger H receiving the latch assembly L, and the lower section 100B, consisting of the tubing hanger H and tubing strings T-1 and T-2, and component parts carried thereon.

Figure 8A:
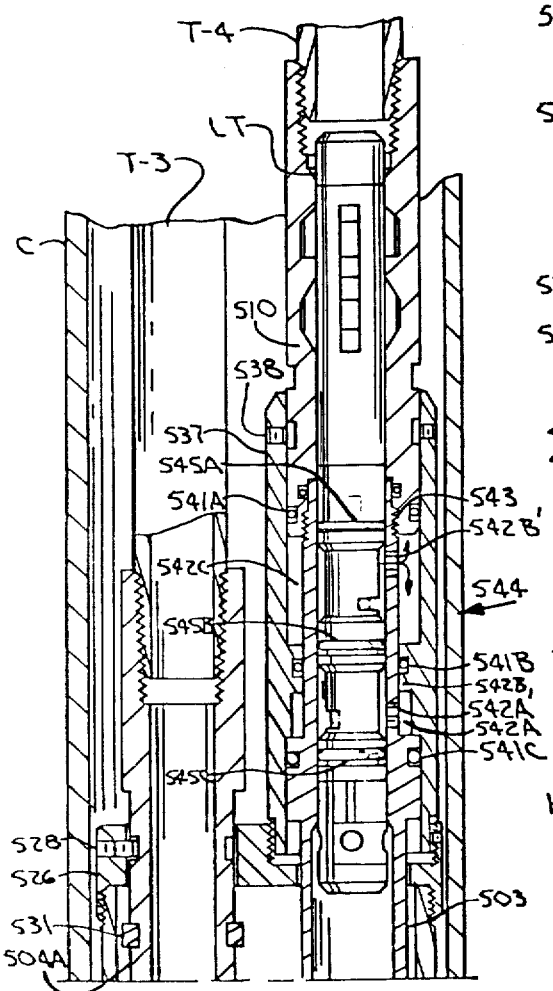
FIGS. 8A, 8B, 8C and 8D together constitute a longitudinal sectional view of the control tool armed in place within the latch assembly subsequent to relatching of the space-out section to the anchored tubing hanger, the flow of fluid being indicated by arrows. The latch fingers are shown in "load contact" during test for proper latching.
Figure 8B:
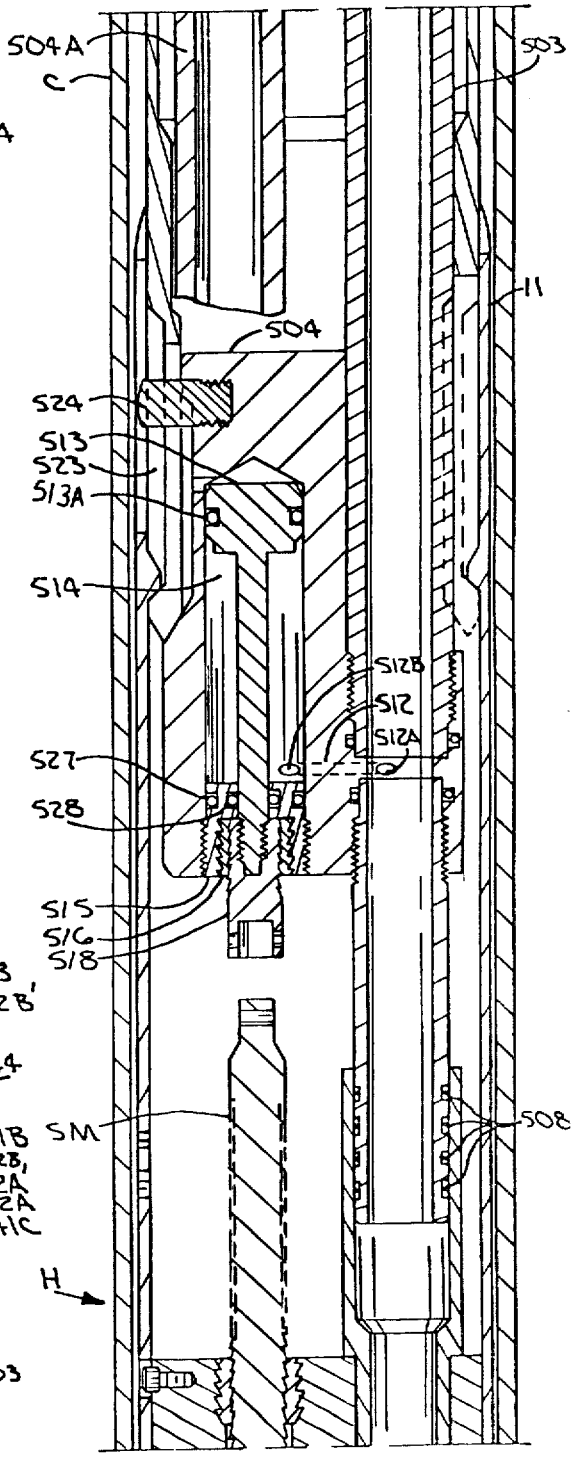
Figure 8C:
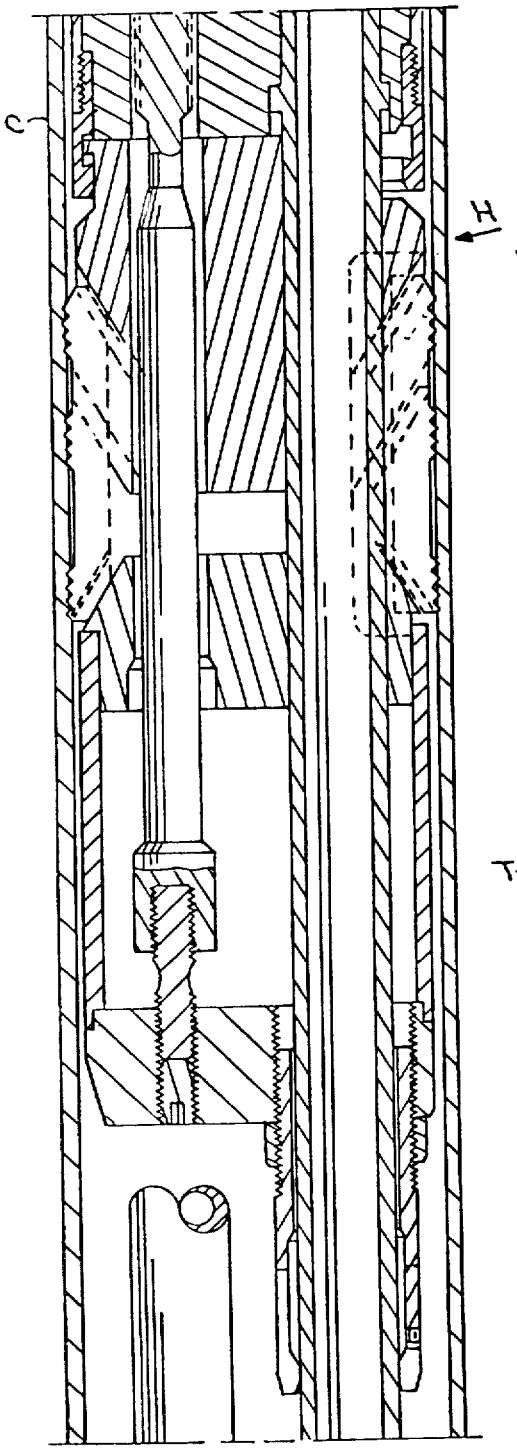
Figure 8D:
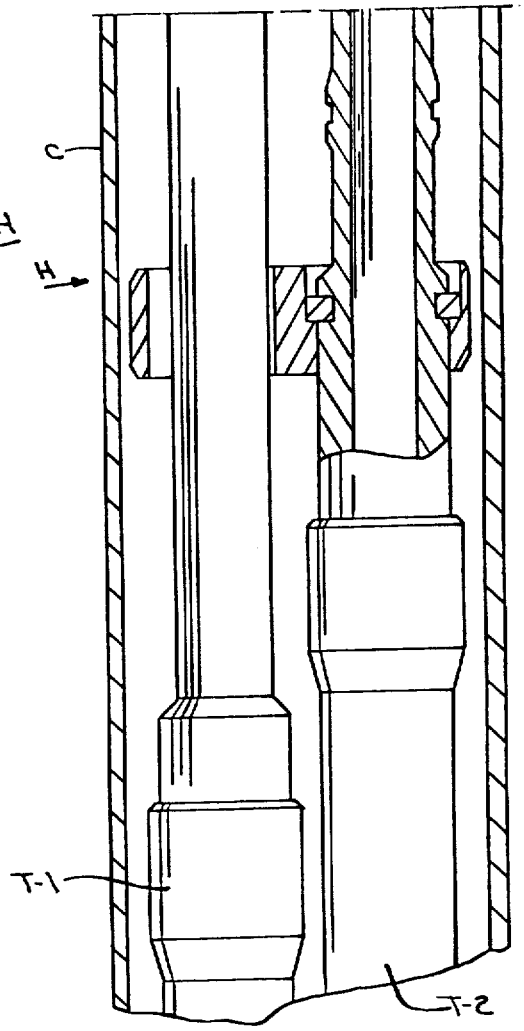
Figure 15:
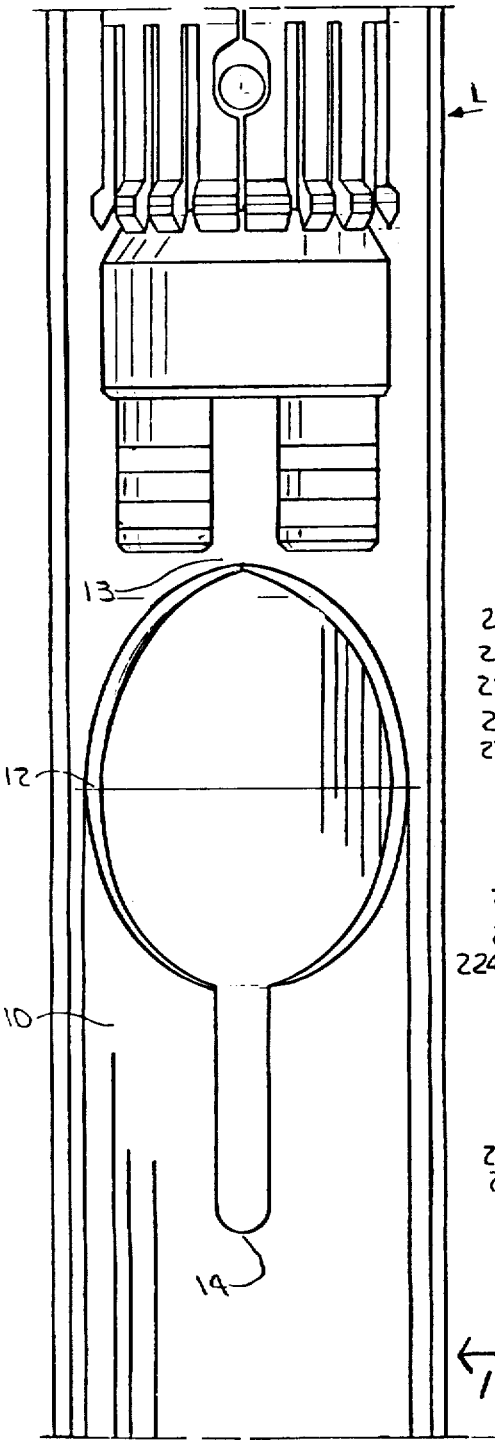
FIG. 15 is an enlarged sectional view illustrating the slotted guide of the tubing hanger receiving the lower seal end of the latch assembly carried on the space-out section during reentry of the space-out section for subsequent relatching into the tubing hanger.

The hanger H utilized in the present invention is adapted to latchingly and sealingly receive the space-out section 100A at its uppermost end and is anchoringly engageable upon the casing C exteriorly defined therearound, in order to transfer the weight of the tubing strings T-1 and T-2 therebelow to the casing C, thus permitting retrieval of the space-out section 100A without retrieval of the tubing strings T-1 and T-2 therebelow. The tubing hanger H is of known design and is as disclosed in detail in U.S. Pat. No. 3,771,603. The tubing hanger H is schematically illustrated in FIGS. 1, 2, 3 and 4, and is shown in detail in set position in FIG. 8C. As shown in FIG. 15, it contains a housing 10 having an upwardly extended tubular guide section 11, the upper end edge 12 of which is arced downwardly from a peak 13, in opposite directions, to a vertically extended slot 14 at the side of the guide section 11 diametrically opposite the peak 13. The guide 11 and slot 14 control the alignment of the lowermost ends of the tubing strings T-3 and T-4 when the space-out section 100A is reinserted within the tubing hanger H.

Figures 5A, 5B:
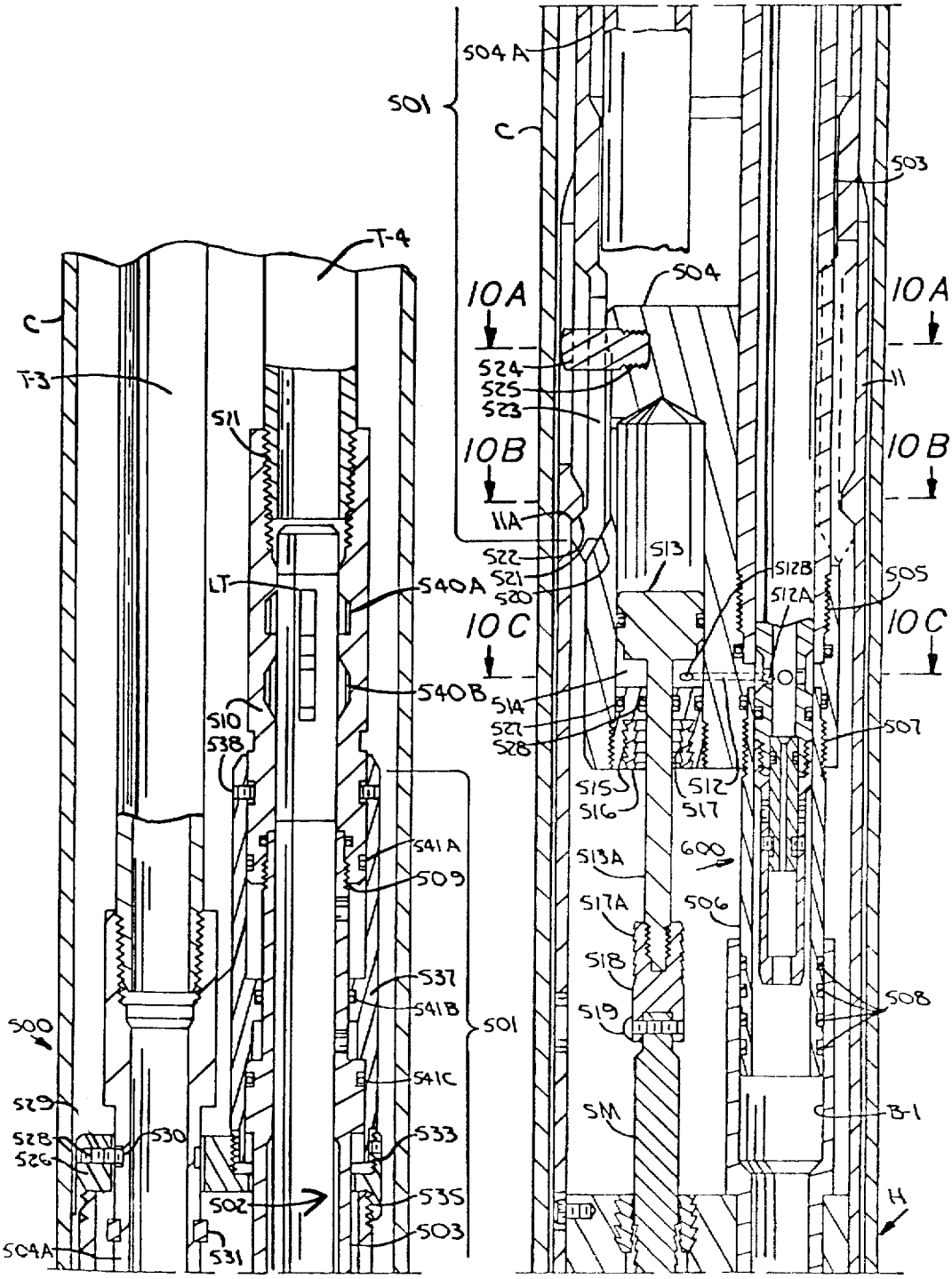
FIGS. 5A, 5B and 5C together constitute a longitudinally extending view of the tubing hanger, the latch assembly and the setting tool in place prior to activation of the setting tool within the latch assembly to anchoringly engage the tubing hanger to the casing.
Figure 5C:
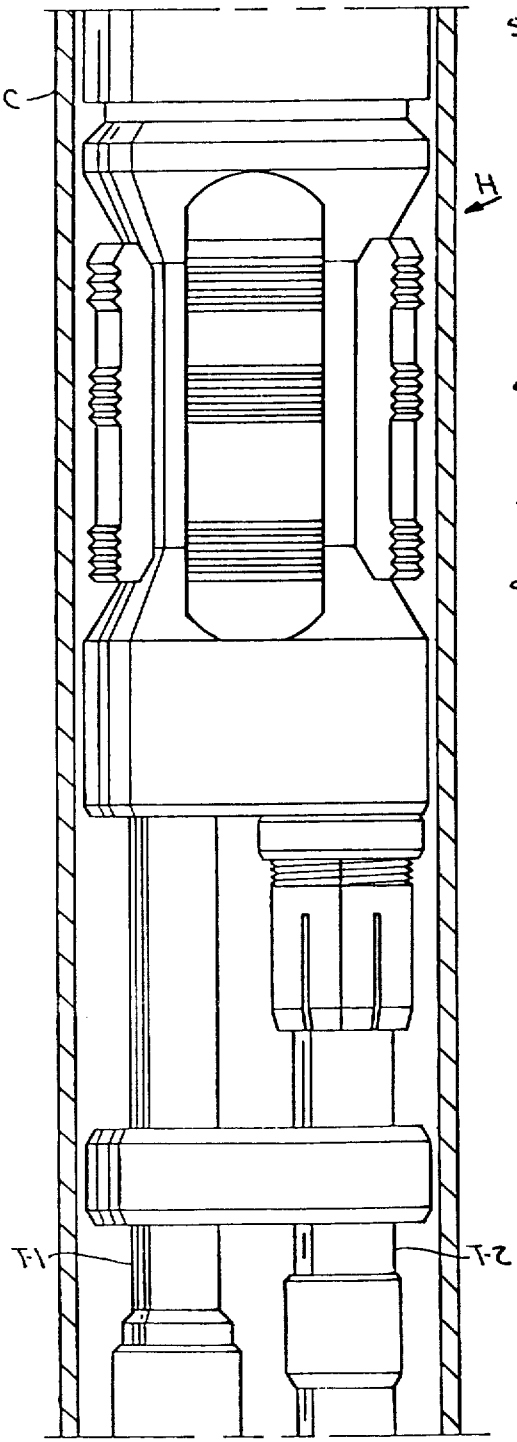
Figure 16:
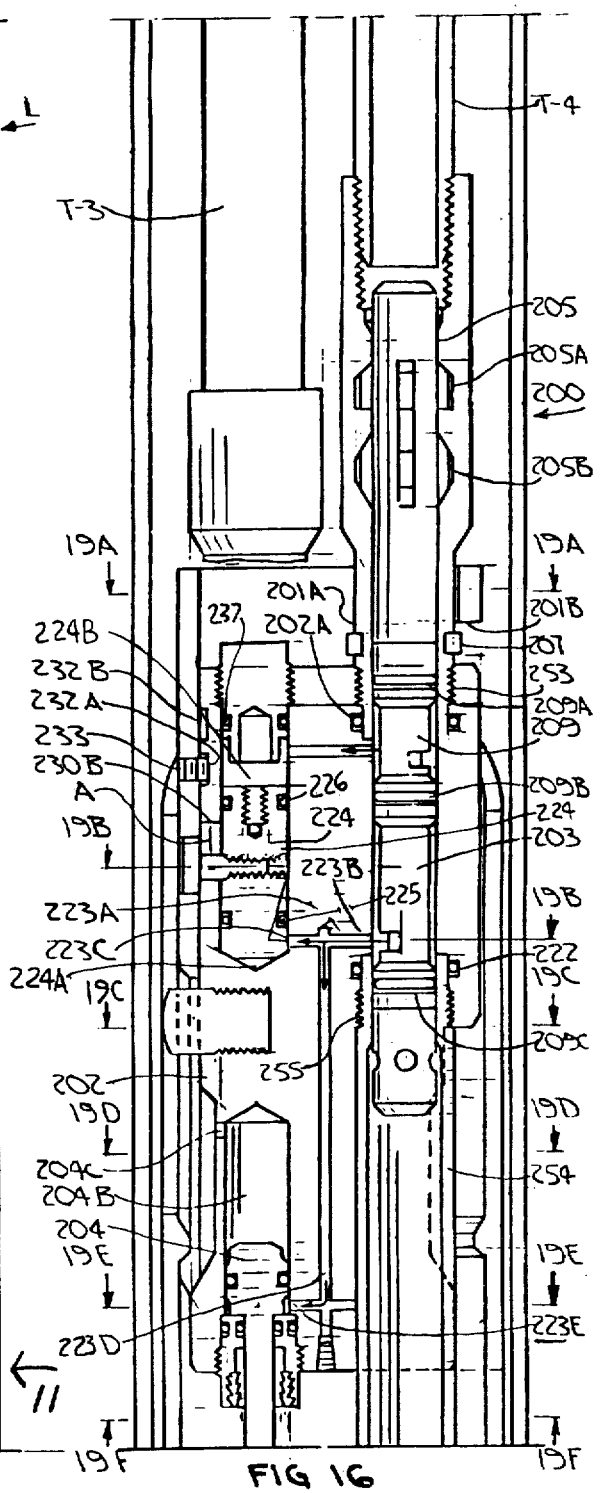
FIG. 16 is an enlarged longitudinally extending view of an alternative latch assembly housing a control tool armed for setting of the tubing hanger, the fluid flow paths being indicated by arrows.
Figure 17:
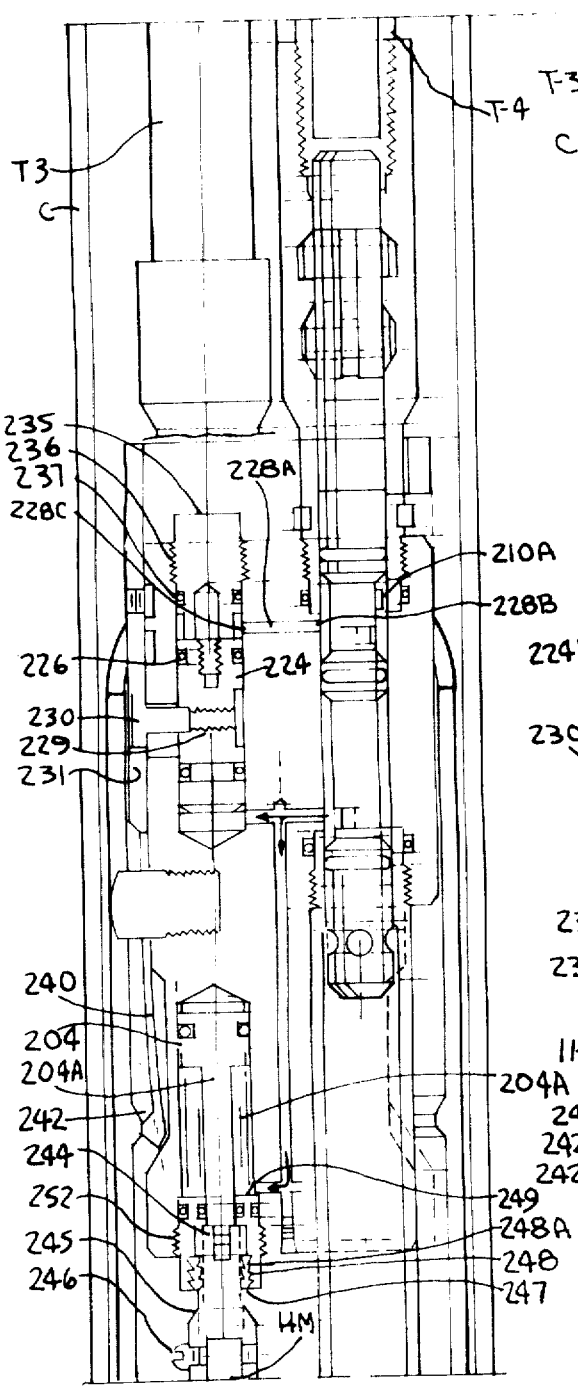
FIG. 17 is a view similar to that of FIG. 16 illustrating the alternate latch assembly with the control tool housed therein and armed for unlatching assembly relative to the tubing hanger, the fluid flow paths being indicated by arrows.
Figure 18:
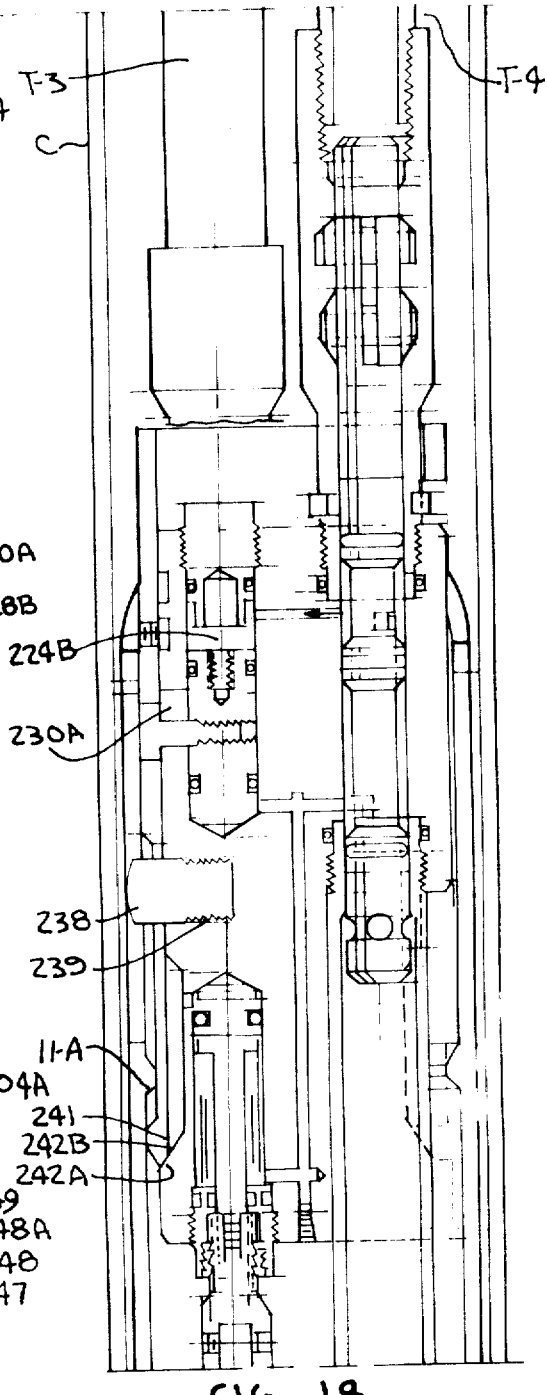
FIG. 18 is a view similar to that of FIGS. 16 and 17, illustrating the alternate latch assembly with the control tool housed therein and armed for relatching of the latch assembly into the tubing hanger, the fluid flow path being indicated by arrows.
Figure 20:
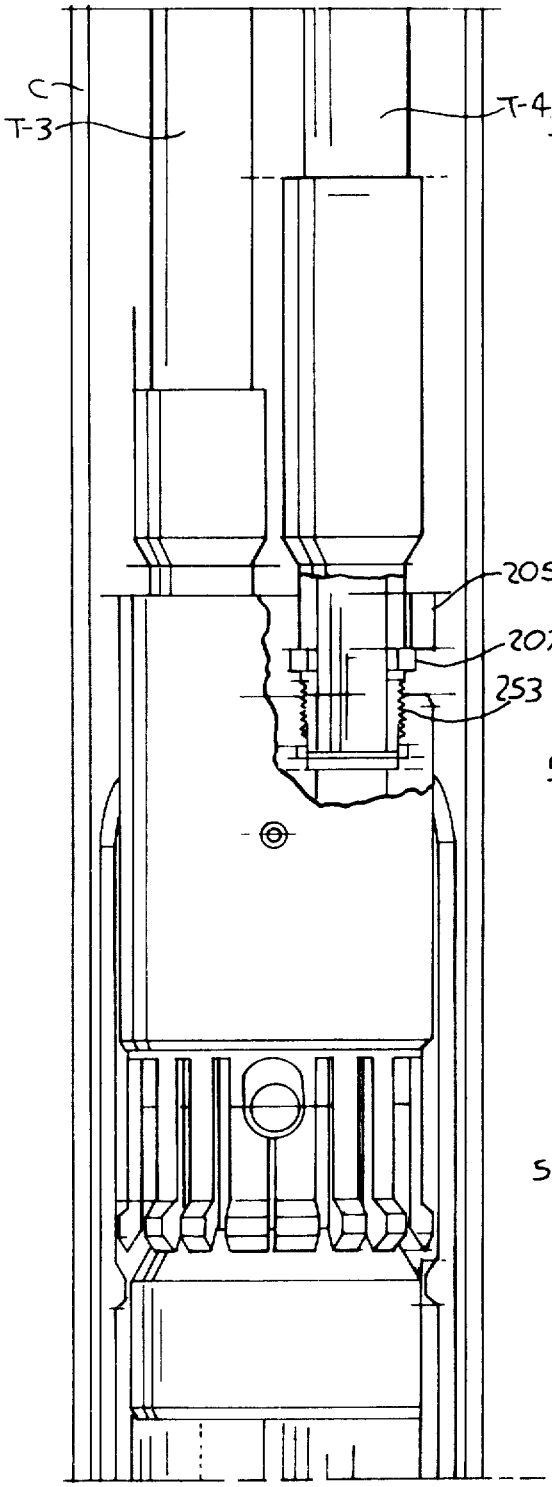
FIG. 20 is an enlarged longitudinal view of the alternate latch assembly and the tubing hanger subsequent to activation of the alternate latch assembly for mechanical unlatching of the latch assembly and the tubing hanger.

The latch assembly L of the present invention may be designed as is latch assembly 500 shown in FIGS. 5A, 5B and 5C, or in a modified latch assembly 200, which incorporates the combined features of unlatching and relatching, together with the ability to set the tubing hanger H without use of a separate setting tool, and as is illustrated in FIGS. 16, 17 and 18.

Now referring to FIGS. 5A, 5B and 5C, the latch assembly 500 consists of an outer housing 501 and an inner housing 502. The inner housing 502 is defined by a longitudinally extending cylindrical mandrel member 503 secured by means of lefthand Acme threads 505 to a latch cone 504, the latch cone 504 securing at its lowermost end and on one side thereof by means of threads 507 a comparatively short seal mandrel 506 having, in turn, at its lowermost end and on the exterior thereof a plurality of circumferentially spaced seal elements 508 which are landed within the inner smooth bore B-1 of the tubing hanger H. The mandrel 503 is secured at its uppermost end by threads 509 to a lock housing 510 having threads 511 at its uppermost end for securement to the upper tubular string T-4.

An extension, 504A (FIG. 5B), is secured to the latch cone 504 with another short seal mandrel identical to seal mandrel 506 and 180° from it and extending into another bore identical to B-1.

The inner housing 502 initially receives the setting tool 600 and provides a hydraulic flow path therethrough to a transverse passage 512 having a portal opening 512A communicating directly to the inner housing 502 and an interiorly extending portal 512B for communication to a lower chamber 514 of a sliding piston 513 extendible within the latch cone 504. The piston chamber 514 is in communication with the port 512 and is effectively defined between the sliding piston 613 and the latch cone 504 between an upper circumferentially extending ring element 526 on the sliding piston 513 and a companion ring element 527 carried around a piston terminal 515. Also, a smaller but similar circumferentially extending ring 528 around the stem 513A of the sliding piston 513 on the piston terminal 515 defines the lowermost end of the piston chamber 514.

The piston terminal 515 is threadedly engaged to the lowermost end of the latch cone 504 and ratchetly carries on its interior a body lock ring 516 having, in turn, ratchet teeth 517 for interratcheting with companion ratchet teeth 517A carried upon a hanger slip mandrel connector 518 threadedly secured to the lowermost end of the stem 513A of the sliding piston 513. The connector 518 carries a shear pin 519 which secures the longitudinally manipulatable slip mandrel SM for the slips of the tubing hanger H.

The latch cone 504 has an exterior upwardly facing interiorly beveled shoulder 520 for snug receipt of a companionly beveled collet finger interior shoulder 521 to permit engagement of the latch assembly 500 into the tubing hanger H and to permit contraction of the latch fingers when the latch assembly 500 is disengaged from the tubing hanger H.

An outer beveled collet shoulder 522 is defined at the lower end of each of the collet fingers 523 which, in turn, is received below a beveled shoulder 11A of the guide 11 of the tubing hanger H.

A guide pin element 524 is secured by threads 525 into the latch cone 504 and is received within the guide 11 of the tubing hanger H along the edge 12 through the slot 14 for proper alignment of the space-out section 100A relative to the tubing hanger H.

The fingers 523, which are cylindrically spaced and carried exteriorly around the inner housing 502, are secured to a latch control ring 526 by means of threads 535, the control ring 526 being secured to a latch cone extension 504A by means of a shear pin 528 secured to the ring 526 by threads 529, the pin 528 being received within a groove 530 exteriorly defined on the latch cone extension 504A.

An emergency mechanical release ring 531 is exteriorly carried around the extension 504A which, upon rotational manipulation of the tubing string T-3, exerts pressure upwards against the lower shoulder 532A of a latch control ring 526 carried exteriorly around the mandrel 503.

The latch control ring 526 secures the collet fingers 523 to a piston mandrel 537 thereabove, which, in turn, is in communication with the tubing string T-4 thereabove, and the latch control ring 526 secures the fingers 523 to the latch cone extension 504A. Since the extension 504A is threaded to the lower end of the tubing string T-3, the fingers 523 are indirectly secured to each of the tubing strings T-3 and T-4.

It should be noted that the lock housing 510 is secured to the tubing string T-4, and it also is secured to the mandrel 537 at the pin 538. Tubing string T-3 is connected to the fingers 523 through the extension 504A because the extension 504A is secured into the latch cone 504 which, in turn, is secured into the fingers 523 through connections between the mandrel 503 and the lock housing 510, and, finally, the shear pin 538.

The latch control ring 526 is secured by threads 533 to the longitudinally extending piston mandrel 537, while threads 535 secure the fingers 523 to the ring 526. The piston mandrel 537 is secured at its uppermost end by means of a shear pin 538 threadedly engaged therein and having its innermost portion extending within a grooveway therefor circumferentially extending around the exterior of the cylindrical lock housing 510.

A wireline activated locking tool LT having selectively expanding dog elements received within locking profiles 540A and 540B is received within the lock housing 510 to resist and prevent further downward travel of the locking tool LT when the setting tool 600 or a control tool 544 is carried at the lowermost end thereof.

Figure 11:
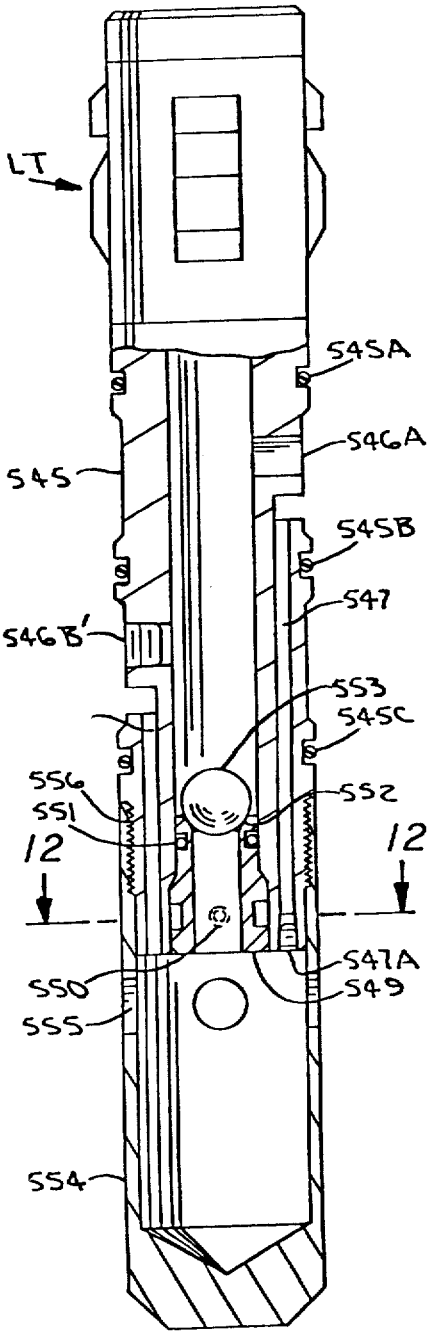
FIG. 11 is an enlarged sectional view of the control tool of the latch assembly armed for relatching of the space-out section into the tubing hanger.
Figure 13:
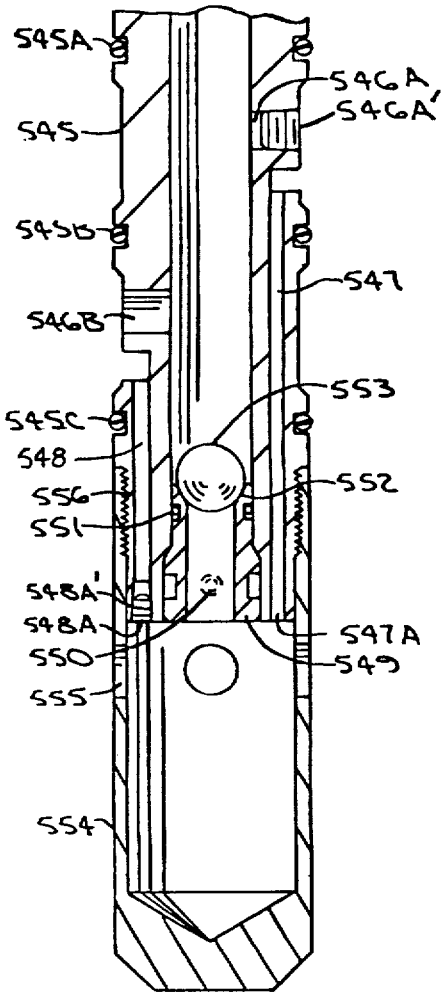
FIG. 13 is a view similar to that of FIG. 11, illustrating the control tool armed for unlatching of the latch assembly relative to the tubing hanger.

Now referring to FIGS. 9A, 11 and 13, the control tool 544 is shown interior of the latch assembly 500 and the mandrel 503 and is utilized in the unlatching of the latch assembly 500 from the tubing hanger H and for relatching of the latch assembly 500, as described below. The control tool 544 is secured at its uppermost end to the locking tool LT at threads 543 and contains an elongated cylindrical housing 545 having secured by threads 556 at its lowermost end a ball seat cage 554. The housing 545 has a series of exteriorly and circumferentially extending elastomeric ring seals 545A, 545B and 545C.

The rings 545B and 545C bridge a port 542A' defined through the mandrel 503 for communication with a piston chamber 542A below a piston head 542B on the mandrel 503. The chamber 542A and the port 542A' communicate to a passage 548 (FIG. 13) cylindrically extending longitudinally through the lower portion of the housing 545 to a port 548A opening into the interior of the cage 554. The port 548A threadedly receives a sealing plug 548A' therein when it is desired to apply pressure through the control tool 544 to shift the fingers 523 upwardly to disengage the space-out section 100A from the lower section 100B.

Companionly, the ring 545B, together with the ring 545A, bridge a port 542B' within the mandrel 503 which, in turn, communicates with a pressure chamber 542C above the piston head 542B. The chamber 542C and port 542B communicate through a longitudinally extending passage 547 (FIG. 13) within the control tool 544 which has a lower port 547A which threadedly receives a sealing plug 547A' (FIG. 11) when it is desired to apply pressure through the control tool 544 to move the latch fingers 523 down relative to the latch cone 504 when it is desired to relatch the space-out section 100A to the lower section 100B. It should be noted that when the control tool 544 is armed for unlatching or relatching, when the port 547A is plugged, the port 548A is unplugged, and vice versa, and during setting of the alternate latch assembly 200, each of the ports 547A and 548A are plugged.

Threaded ports 546A and 546B are provided on the housing 545 for selective communication to the chambers 542C and 542A, respectively. When it is desired to apply pressure through the control tool 544 to disengage the latch 500 from the tubing hanger H, a seal plug 546A' is inserted through the port 546A, as illustrated in FIG. 13. Alternatively, when it is desired to relatch the latch assembly 500 to the tubing hanger H, the threaded port 546B receives a companion seal plug 546B', as shown in FIG. 11.

Thus, it can be seen that by selectively plugging the ports 546A, 546B, 547A and 548A, the chambers 542A and 542C can act as either pressure or exhaust chambers.

Elastomeric ring element 541A is defined on the exterior around the lock housing 510 to prevent fluid communication between the lock housing 510 and the piston mandrel 537, and defines the uppermost end of the chamber 542C, while ring 541C, carried exteriorly around the mandrel 503, prevents fluid communication between the mandrel 503 and the piston mandrel 537, and also defines the lowermost end of the chamber 542A.

Figure 12:
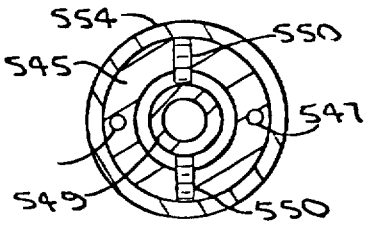
FIG. 12 is a cross-sectional view taken along line 12—12 of FIG. 11.

The housing 545 of the control tool 544 contains a ball seat sleeve 549 (FIG. 11) which is secured to the housing 545 by means of shear pins 550 spaced in between the passages 547 and 548, as shown particularly in the cross-sectional FIG. 12. An elastomeric ring element 551 is carried exteriorly around the uppermost and of the ball seat sleeve 549 to prevent fluid communication between the sleeve 549 and the housing 545.

When it is desired to activate the control tool 544 either to unlatch the latch assembly 500 or to relatch the latch assembly 500 relative to the tubing hanger H, a ball 553 is pumped or gravitated through the tubing string T-4 and through the housing 545 until it sealingly rests upon the seat 552 of the sleeve 549. Thereafter, pressure is selectively applied either through port 546B and/or 546A, depending upon the desired operation to be conducted. When the unlatching or relatching operation is completed, additional pressure is applied through the control tool 544 until such time as the shear strength of the pins 550 is overcome. The pins will shear and the sleeve 549 will be permitted to be captured within the cage 554, thus preventing further lower travel of the ball 553 and the sleeve 549 within the assembly 100 and within the well W. Thereafter, fluid may be pumped through the tubing string T-4 through the control tool 544, thence through a port 555 within the cage 554 and lowerly through the inner housing 502 and the lower section 100B.

As shown in FIGS. 1, 2, 3 and 4, the latch assembly 500 initially is carried on the tubing strings T-3 and T-4 together with the remaining components of the space-out section 100A and the lower section 100B in a single trip into the well bore W with the setting tool 600 in place on the latching tool LT.

Figure 6:
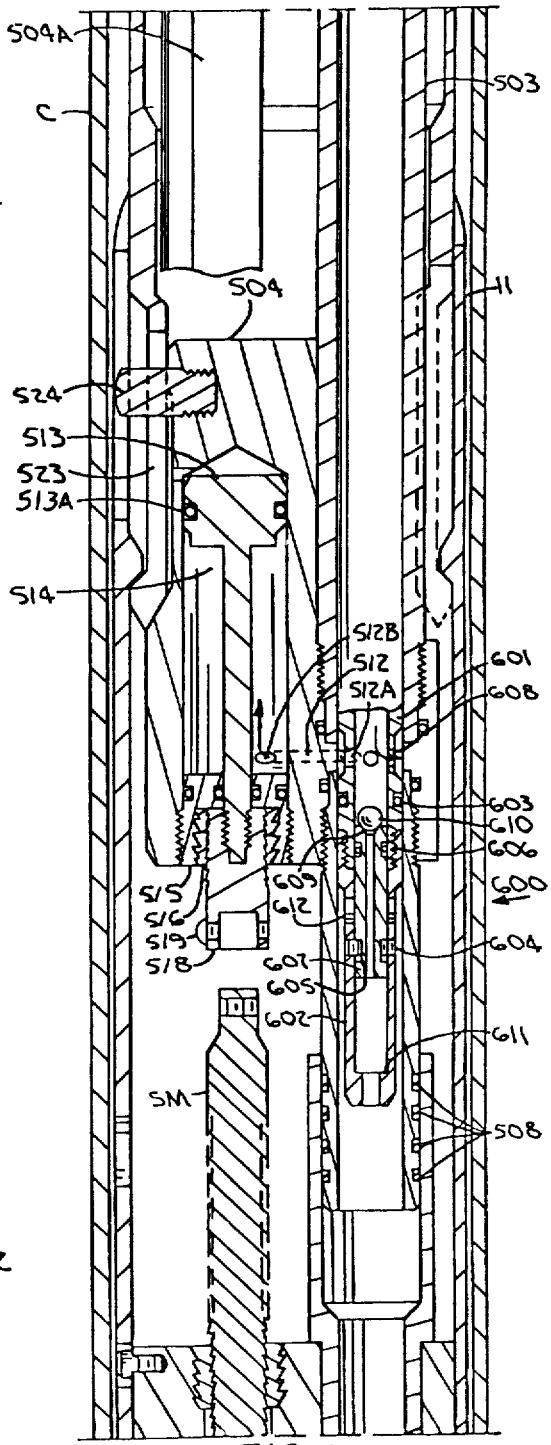
FIG. 6 is an enlarged view of the setting tool and the latch assembly illustrated in FIGS. 5A and 5B, subsequent to the setting of the tubing hanger, the flow of fluid being illustrated by arrows.
Figure 7:
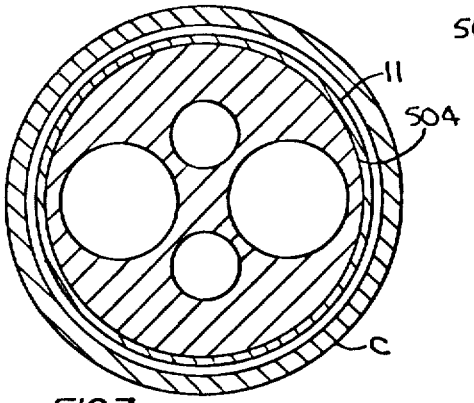
FIG. 7 is a 360° cross-sectional view taken along the 90° line 7—7 shown in FIG. 1.

Referring to FIGS. 5B and 6, the setting tool 600 is of conventional design and consists of an outer elongated body 601 secured to the latching tool LT by means of threads (not shown) at its uppermost end. An elastomer ring 603 is defined exteriorly of the outer body 601 for smooth sealing engagement along the i.d. of the lowermost end of the inner housing 502 to prevent fluid communication thereabove between the setting tool 600 and the mandrel 503. A sleeve housing 602 is secured at the lowermost end of the outer body 601 by threads 606, the housing 602 receiving therethrough a transverse shear pin 604 which has its innermost end secured snuggly within a circumferentially extending exterior groove 605 defined on a shear sleeve 607 interior of the outer body 601 and the sleeve housing 602. The sleeve 607 contains a ball seat 609 for receipt of a ball 610 which is either pumped or gravitated through the tubing string T-4 for receipt, sealingly, on the seat 609 when it is desired to set the tubing hanger H, as described below. A port 608 is defined through the outer body 601 and communicates to the exterior of the setting tool 600 to the port 512A to the port passageway 512 in the latch cone 504 to the piston chamber 514 below the sliding piston 513, to urge the piston 513 upwardly carrying the slip mandrel SM of the tubing hanger H and thereby urging the slips outwardly into gripping engagement with the wall of the casing C to properly anchor the tubing hanger H. Upon application of pressure after seating of the ball 610 on the seat 609 to set the tubing hanger H, the shear pin 604 is sheared, permitting the sleeve 607 to shift longitudinally within the sleeve housing 602 until the lowermost end of the sleeve 607 contacts a shoulder 611 on the housing 603, thereby preventing further lower longitudinal travel of the sleeve 607. In this position, a port 612 in the sleeve housing 603 is open to the interior of the setting tool 600, thus permitting fluid to be circulated thereacross and into the lower section 100B.

As shown schematically in FIGS. 2, 3 and 4, and as detailed in FIGS. 23A and 23B, the swivel sub 300 is an optional embodiment within the space-out assembly 100A and may be carried on one or more of the tubing strings T-3 and T-4 somewhat below the safety valves SV. The swivel sub 300 is provided in order to be able to rotate one or both of the tubing string T-3 and T-4 between the swivel sub 300 and the latch assembly L when the tubing strings T-3 and T-4 between the swivel sub 300 and the split surface hanger SSH are rigidly threaded into the hanger SSH, in order to provide tubular rotation without "binding" safety valve control tubing to mechanically unlatch the latch assembly L from the hanger H, as a backup means, in the event that hydraulic unlatching is not possible or feasible.

The swivel sub 300 consists of a swivel sub housing 302 and an actuator 301. The swivel sub housing 302 consists of an outer cylindrical housing 303 which is secured by threads 309 to a top sub 304, which, in turn, is secured by threads 305 to a section of the respective tubular string T-3 and/or T-4. The outer housing 303 is secured at its lowermost end to a lower guide member 307 by means of threads 308. A spline mandrel 312 is cylindrically carried within the interior of the outer housing 303 and the lower member 307 and is secured to its lowermost end to a section of the respective tubing strings T-3 and T-4 at threads 306. In between the spline mandrel 312, the outer housing 303 and the top sub 304 is a bearing assembly 310 for minimizing transmission of torque through the swivel sub housing 302 as the tubular string is rotated. The bearing assembly 310 also is provided to sustain the weight of the tubing string above the swivel sub 300. Elastomer rings 311 are carried internally on the top sub 304 to prevent fluid communication between the sub 304 and the spline mandrel 312.

The spline mandrel 312 contains a series of inwardly extending circumferentially spaced and longitudinally extending splineways 313 which receive rotational spline dogs 317 carried on the swivel sub actuator 301 to permit interengagement between the actuator 301 and the swivel sub housing 302 to provide means for transmitting torque as a result of tubular rotation thereabove to the tubing section therebelow. Limiting grooves 314A and 314B are interiorly profiled on the spline mandrel 312 for receipt of first and second travel resistors 320 on the actuator 301 to prevent further longitudinal travel of the actuator 301 within the swivel sub housing 302.

The actuator 301 for the swivel sub 300 is carried on an auxiliary work string (not shown) which is insertable within one of the respective tubular strings T-3 and T-4 with the actuator 301 secured at the lowermost end thereof by means of threads 315. A control mandrel 316 houses a series of exteriorly extending circumferentially spaced rotational dogs 317 which are urged outwardly of the mandrel 316 by means of the force defined through springs 318 housed within the dog 317 and the mandrel 316. A spacer 319 is carried around the mandrel 316 on and below the dogs 317 and interfaces with the travel resistors 320 urged outwardly by upper and lower spring members 321 carried within the resistors 320 and the mandrel 316, the resistors 320 being also circumferentially spaced around the exterior of the mandrel 316 for companion engagement within the limiting grooves 314A and 314B to prevent further longitudinal travel of the actuator 301 within the housing 302 of the swivel sub 300. At the lowermost end of the actuator 301 is a resistor ring 322 secured to the mandrel 316 by means of threads 323.

When it is desired to rotate the tubing string below the swivel sub 300, as described below, the actuator 301 is run on the auxiliary work string until such time as the travel resistors 320 land in the grooves 314A and 314B of the housing 302. At such time, the rotational dogs 317 also have landed adjacent the splines 313 and have been interengaged therebetween. In the event that the dogs 317 and splines 313 are not interengaged, a mere rotation of the auxiliary work string will permit the dogs 317 to quickly come into interengagement with the splines 313 because of the outward urging of the dogs 317 by the spring 318. After interengagement of the dogs 317 and the splines 313, the actuator 301 is in rotational transmission alignment with the swivel sub housing 302 and continued rotation of the auxiliary work string will transmit rotational force from the work string through the swivel sub 300 to the section of the tubing string therebelow to initiate disengagement of the latch assembly L from the hanger H, as further described below.

Now referring to FIGS. 1, 2, 3 and 4, the shear-out safety joint 400 is schematically illustrated on each of the tubing strings T-3 and T-4 spaced somewhat below each of the rotational adjustment subs RAS and above the safety valves SV. It is not essential in the operation of the assembly of the present invention to incorporate one or more shear-out safety joints 400 in the space-out section 100A, the function of the shear-out safety joint 400 being to provide a means of separating the tubing string above the safety valves SV when a predetermined weight load across the shear-out safety joint 400 is exceeded. Alternatively, the safety joint 400 may be excluded from incorporation within the components defining the space-out section 100A. However, when a shear-out safety joint is utilized in the one trip tubing hanger assembly of the present invention, it is mandatory that such joint provide for carriage of a weight load up to the full tubing strength of each of the combined tubing sections T-1 and T-3, T-2 and T-4, in order to facilitate a preliminary operation prior to the setting of the tubing hanger H, such as the setting of a packer apparatus therebelow, or the like. This is accomplished in the shear-out safety joint 400 by the incorporation of a bridge which initially provides such a weight load carrying capability. The bridge may be removed to relax the capability for weight load carriage of the shear-out safety joint 400, such that it may thereafter operate as a conventional shear-out safety joint.

Figure 22A:
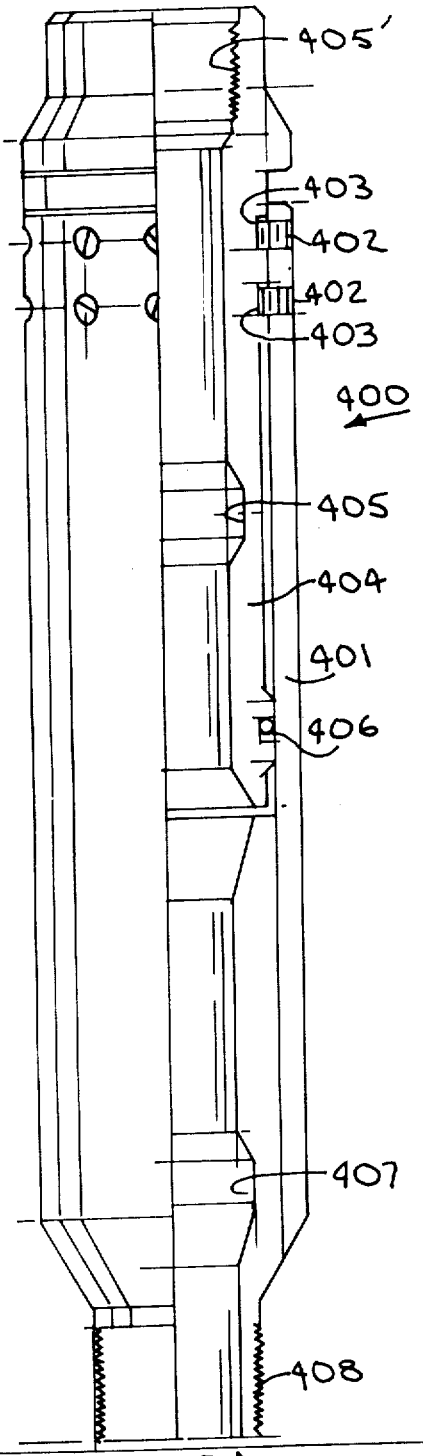
FIG. 22A is a view of the shear-out safety joint after retrieval of the bridge element from the interior.
Figure 22B:
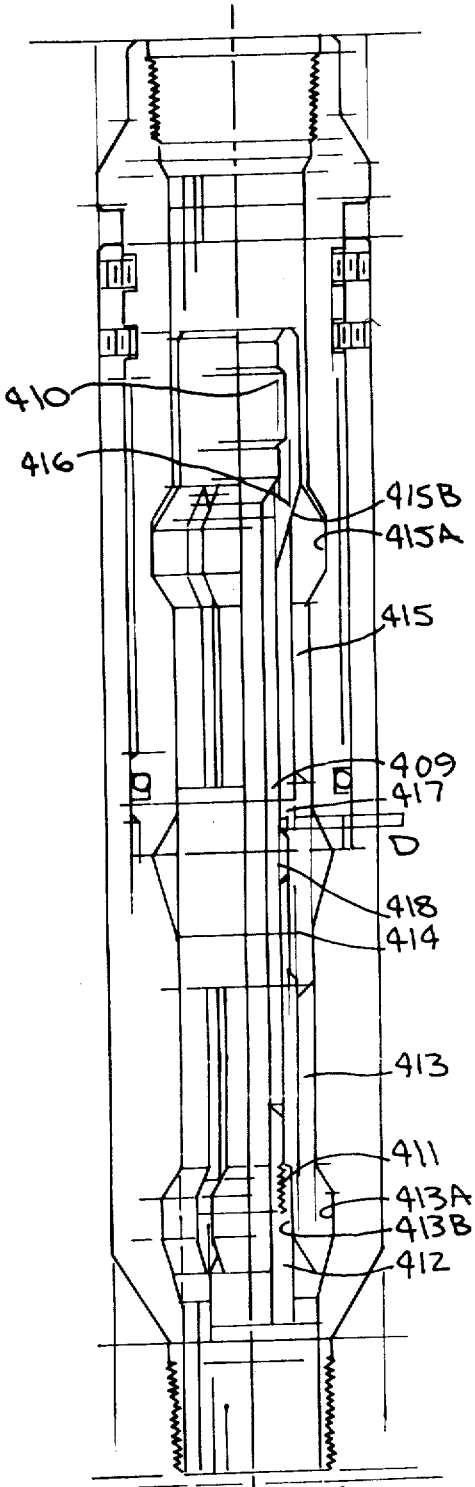
FIG. 22B is a view of the shear-out safety joint with the collet and the collet mandrel secured in place within the interior for transmitting a load through the shear-out safety joint in excess of the load held through the apparatus in the position as shown in FIG. 22A.

The shear-out safety joint 400 shown in FIGS. 22A and 22B comprises an outer housing 401 which is secured by shear pins 402 to an inner housing 404, the shear pins 402 being respectively inserted within a positioned milled hole 403 exteriorly around the uppermost portion of the inner housing 404. It is this means of affixation which normally provides the shear-out feature of the safety joint 400, and permits torque in the tubing strings T-3 and T-4 to be transmitted across the safety joint 400.

Threads 405' secure the inner housing 404 to a section of the respective tubular string T-3 and T-4, thereabove. An elastomeric seal ring 406 is defined at the lowermost end of the inner housing 404 to prevent fluid communication between the housings 404 and 401. An upper collet profile 405 interiorly defined on the inner housing 404 and a companion lower collet profile 407 defined on the outer housing 401 serve to engage a collet 414 to define a bridge for initial weight load carrying capacity between the inner housing 404 and the outer housing 401. Threads 408 are defined exteriorly on the lowermost end of the outer housing 401 for affixation of the shear-out safety joint 400 to a section of tubular string therebelow of the respective tubing string T-3 or T-4.

As shown in FIG. 22B, a control mandrel 409, cylindrical in nature, is housed interior of the inner housing 404 and the outer housing 401. The mandrel 409 is profiled at its upper end to define a fishing neck 410 for insertion thereon of the lower end of a fishing tool (not shown) manipulatable by a wireline to retrieve the control mandrel 409 and the collet 414, thus removing the "bridge" and increased weight load carrying capacity of the shear-out safety joint 400, as described below. A short collet support 412 is secured by threads 411 to the lowermost end of the control mandrel 409, with an outwardly protruding shoulder 418 also being defined on the control mandrel 409 and being set a distance "D" slightly below an engaging shoulder 417 of the collet 414.

The collet 414 is secured between the control mandrel 409 and the housings 401 and 404 and has upwardly extending finger elements 415 having an outer surface 415A which is securely engaged within the collet profile 405 on the inner housing 404, while similarly constructed lower fingers 413 of the collet 414 have an outer surface 413A which also is engaged within a companion lower collet profile 407 on the lowermost portion of the outer housing 401.

The shoulder 417 on the collet 414 is above the shoulder 418 on the control mandrel 409, the distance "D", initially.

An interior shoulder, beveled, 415B on the upper finger 415 is engaged by a companion bevel 416 on the control mandrel 409 to urge the fingers 415 into the collet profile 405. A similar positioned elongated cylindrical exterior surface 413B on the collet support 412 urges the fingers 413 into the lower collet profile 407.

After the setting of the tubing hanger H, it will typically be desirable to reduce the weight load carrying capacity of the shear-out safety joint 400 by removing the "bridge" provided by the initial positioning of the control mandrel 409 and the collet 414 within the inner housing 401. Therefore, a conventional fishing tool is run by wireline and affixed to the fishing neck 410 of the control mandrel 409. The control mandrel 409 is pulled upwardly and as the distance "D" is contracted, the shoulder 418 on the control mandrel 409 will contact and engage the shoulder 417 on the collet 414. Accordingly, the bevel 416 of the control mandrel 409 and the interior surface 413B will be moved upwardly, correspondingly, to the amount of the distance "D", and beyond, in the up direction, thus enabling continued upward movement of the control mandrel 409 to urge the fingers 415 and 413 out of engagement with the respective collet profiles 405 and 407.

Since the shoulder 18 is part of the mandrel 409, when the mandrel 409 is pulled, the shoulder 418 is deflected inwardly until it passes through the shoulder 417. The mandrel then moves upward until the support 412 contacts the shoulder 417. The collet 414 is then pulled out of the housings 401 and 404 through this contact.

When the control mandrel 409, together with the collet 414, are released from the housings 404 and 401 and withdrawn from the strings T-3 and T-4 by wireline, the shear-out safety joint 400 now has the weight load carrying capability up to that defined through the shear pins 402. Additional weight load thereon, such as by applying additional pulling force through the respective tubing strings T-3 and T-4 will cause the shear pin 402 to be sheared, thus separating the inner housing 404 from the outer housing 401, and enabling retrieval of the respective tubing string together with the inner housing 404, and thereafter leaving the safety valves SV in place and, preferably, in the closed position for control of the well.

The latch assembly L may be provided in an alternative embodiment which does not necessitate utilization of a separate setting tool for setting of the tubing hanger H and a separate control tool for unlatching and relatching of the space-out section 100A into the lower section 100B.

Now referring to FIG. 16, an alternative latch assembly 200 is illustrated in a design incorporating two pistons for manipulation of the slips for the proper anchoring of the hanger H. However, it is not essential that the latch assembly 200 be provided with plural pistons, although this is preferable from a manufacturing viewpoint, and it should be understood that the latch assembly 200 is easily designed to incorporate only one setting piston. Again, as is true with the latch assembly 500, the assembly 100 incorporating the modified latch assembly 200 utilizes a tubing hanger H as shown in FIGS. 1, 2, 3, 4, 8C and 8D, and as described in U.S. Pat. No. 3,771,603, issued Nov. 13, 1973, entitled "Dual Safety Valve Method And Apparatus", the disclosure of which is again incorporated by reference.

Now referring to FIGS. 16, 17 and 18, the latch assembly 200 basically comprises a collet assembly 201 carried exteriorly around a latch cone 202 which, in turn, functionally houses a wireline seated control tool 203. The latch cone 202 houses at its lowermost end a piston 204 for longitudinal manipulation of a hanger mandrel HM connected at the lowermost end thereof to shift the slips of the tubing hanger H into anchoring engagement on the wall of the casing C.

Secured to the upper end of the latch cone 202 by threads 253 is a longitudinally extending lock housing 205 which, in turn, is threadedly secured to the tubing string T-4. The lock housing 205 contains lock profiles 205A and 205B for securement to the housing 205 of conventional wireline locks secured at their lowermost end by threads to a cylindrical body 209 of the control tool 203.

An elastomer ring 202A is circumferentially carried within the latch cone 202 and around the exterior of the lowermost end of the lock housing 205 to prevent fluid communication between the housing 205 and the cone 202.

An emergency release ring 207 is carried on and outwardly protrudes away from the outside diameter of the lock housing 205 within a ring passage 201A in the collet 201 for resisting engagement with a lower face or abutment 201B on the collet 201 to provide applied relative longitudinal movement between the collet 201 and the latch cone 202 during auxiliary mechanical release of the latch assembly 200 from the tubing hanger H, as described below.

An elongated cylindrical body 209, together with a ball cage 219 secured to the body 209 by threads 220 define the exterior constituents of the control tool 203.

Elastomer rings 209A, 209B and 209C are exteriorly and circumferentially spaced on the control tool 203, the rings 209A, 209B and 209C being static, and preventing fluid communication between the lock housing 205, the latch cone 202, and a tubing extension 254, respectively, and the control tool 203. Additionally, rings 209A and 209B bridge the uppermost portion of an elongated cylindrical passage 212 (FIG. 14) defined through the control tool 203 and between the control 203 and the lock housing 205 and the latch cone 202, the passage 212 upwardly communicating with a threaded port 210 and terminating at the lowermost end of the control tool 203 in a threaded port 212A.

Concurrently, the rings 209B and 209C bridge the uppermost portion of a cylindrical passage 213 defined through the control tool 203 and exteriorly thereof between the rings 209B–209C between the control tool 203, the latch cone 202 and the tubing extension 254. A threaded port 211 communicates the interior of the control tool 203 with the passage 213. The passage 213 is defined at its lowermost end by threaded port 213A. Additionally, the pressure area defined between rings 209B and 209C also is utilized to transmit hydraulic fluid through a passage in the latch cone 202 to a chamber 204A below the piston 204 to initially set the slips of the hanger H along the wall of the casing C.

When the plugs 210A and 211A are not within the ports 210–211, and the plugs 212B–213B are secured in the ports 212A–213A, and the interior of the body 209 is plugged at its lowermost end, the control tool 203 is armed for setting of the tubing hanger H.

When the seal plug 210A (FIG. 17) is threadedly secured within the port 210 and the seal plug 213B is threadedly engaged within the port 213A, and the interior of the cylindrical body 209 is plugged at its lowermost end, hydraulic pressure can act between the rings 209B-209C and be transmitted through the port 211 below the piston 224 to urge the piston 224 and the fingers 240 upwardly to unlatch the latch assembly 200 from the tubing hanger H.

Concurrently, when the threaded port 212A is plugged with plug 212B and threaded port 211 is plugged with plug 211A, and the bottom of the interior of the cylindrical body 209 also is plugged, as in FIG. 18, hydraulic pressure is permitted to act between the rings 209A-209B through the port 210 to shift a piston element 224 downwardly within the latch cone 202 and carry the fingers 240 therewith to secure the fingers 240 to the guide 11, as further described below.

A ball shear-out sleeve 214 is carried at the lowermost end of the cylindrical body 209 and secured thereto by shear pins 215. A beveled seat 216 is defined at the uppermost end of the sleeve 214 for selective sealing receipt of a ball 217 which may be pumped or gravitated through the tubing string T-4, thence through the control tool 203 when it is desired to set the tubing hanger H or unlatch or relatch the latch assembly 200 from the tubing hanger H.

An elastomer ring 218 is carried on the sleeve 214 to prevent fluid communication between the sleeve 214 and the body 209.

The cage 219 secured to the body 209 by threads 220 has a port 221 communicating with the interior thereof and the interior of a tubing extension 254 for fluid communication to and through the lower tubing string T-2. The cage 219 will catch the ball shear-out sleeve 214 subsequent to increase of pressure after setting unlatching or relatching of the tubing hanger H, when it is desired to circulate fluids through the tubing string T-4 to the tubing string T-2 into one of the zones Z-1 and Z-2, thence upwardly through the well W through the annular area exterior of the casing C.

An elastomer ring 222 is carried on the latch cone 202 and circumferentially around the uppermost end of the tubing extension 254 secured by threads 255 to the cone 202 to prevent communication between the cone 202 and the extension 254.

The port 211 in the body 209 communicates to the latch cone 202 through a companion port 223B of a transverse cylindrical fluid passage 223A in the cone 202, the passage 223A in turn having a port 223C facing a pressure chamber 224A below a piston 224. The passage 223A is intersected by a longitudinally extending passage portion 223D in the cone 202 which, in turn, terminates through a port 223E to a piston pressure chamber 204A below the head of the piston 204.

To anchor the tubing hanger H to the casing C, fluid pressure is transmitted from the control tool 203 through the port 211, thence to the port 223B and the passages 223A-223D to the port 223E and the chamber 204A to urge the piston 204 up to longitudinally shift the hanger mandrel HM upwardly to urge the slips into anchoring engagement with the inner wall of the casing C. Fluid also is permitted to enter into the chamber 224A through the port 223C below the piston 224, but does not act effectively on the piston 224 to shift it longitudinally because the plugs 212B and 213B are sealingly secured within the threaded ports 212A and 213A, respectively, in the cylindrical body 209 of the control tool 203, the ports 210 and 211 in the body 209 being open during this operation, with the port 210 effecting pressure equalization across a piston 224, and prevent its movement.

The latch cone 202 also houses a longitudinally selectively shiftable piston 224 having an elastomer ring 225 carried thereon to prevent communication between the piston 224 and the cone 202. This ring 225 is dynamic, and defines the uppermost end of the piston chamber 224. The piston 224 also carries a similar ring 226 at its uppermost end which also is dynamic.

The cone 202 also defines a transverse fluid passage 228A thereacross having an exterior port 228B communicating to the passage 212 in the body 209 of the control tool 203, and an interiorly facing port 228C communicating to the upper face of the piston above the ring 226 and into a chamber 224B. The chamber 224B terminates at its upper end at ring 237 carried circumferentially around the exterior of a piston cap 235 secured at threads 236 to the uppermost end of the latch cone 202.

The piston 224 secures at threads 229 a shoulder screw 230 exteriorly protruding through and out of the latch cone 202 into a receiving bore 231 in the collet 201. When the space-out assembly 100A initially is run in the well together with the lower section 100B, the screw 230 is inserted through an opening 230A in the cone 202 and distance "A" is defined between the upper face 230B defining the opening 230A and the screw 230. The distance "A" defines the upward permissible longitudinal travel of the screw 230 for initial unlatching of the finger 240 and also defines the distance of lower travel of the screw 230 as the latch assembly 200 is relatched into the guide 11 of the tubing hanger H.

A shear pin 233 is secured by threads on the collet 201 and protrudes within a first groove 232A therefor into the cone 202, the pin 233 initially securing the collet 201 to the cone 202. A second groove 232B is provided thereabove for resetting of the piston 224 for relatching operation.

A guide pin 238 is secured into the cone 202 by means of threads 239 and protrudes outwardly of the cone 202 and in between the fingers 240 to guide the latch assembly 200 into the guide 11, the guide pin 238 encountering the edge 12 of the guide 11 and being rotationally aligned with the guide 11 when the pin 238 is received within the slot 14 to properly align the tubing strings T-3 and T-4, when the latch assembly 200 is relatched into the tubing hanger H.

The latch fingers 240 are circumferentially spaced around the exterior of the latch cone 202 and are initially secured thereto by shear pins 233 within the groove 232A. Each finger has a spoon-like lower end 241 having a downwardly slanting exterior shoulder 242 for latching contact with a companionly shaped downwardly beveled inwardly protruding latch abutment 11A on the guide 11. The spoon 241 also has an interiorly facing downwardly shaped bevel 242B companionly contacted by an exteriorly protruding sloped shoulder 242A on the latch cone 202, the interface of 242B-242A and 242-11A securing the spoon 241 such that the latch assembly 200 is secured to the tubing hanger H.

The piston 204 is housed within the latch cone 202 and is utilized to transfer hydraulic force to mechanical motion to longitudinally shift the hanger mandrel HM to move the slips into anchoring engagement with the interior wall of the casing C to set the tubing hanger H. An exhaust chamber 204B is cylindrically defined within the cone 202 and above the piston 204 and communicates through a vent 204C to the exterior thereof to permit longitudinal shifting of the piston 204. Below the piston 204 is the chamber 204A' which communicates to the port 223E and its associated passageways to receive hydraulic pressure to shift the piston 204 upwardly. Threads 244 on a piston stem 204A secure the stem 204A to a hanger slip mandrel connector 245. The connector 245 transversely receives a shear pin 246 which connects the connector 245 to the hanger mandrel HM. Subsequent to setting of the slips of the tubing hanger H, and while shearing out the ball sleeve 214, the pin 246 will shear, thus separating the latch assembly 200 from the tubing hanger H for subsequent unlatching.

The connector 245 also has defined thereof exterior and circumferentially extending ratchet teeth 247 which are ratchetly received within companion ratchet teeth 248 defined interiorly on a lock ring 248A held on a piston terminal 249 which in turn is secured by threads 252 to the latch cone 202, the terminal 249 having an elastomeric ring defined circumferentially around the uppermost interior thereof to prevent fluid communication between the terminal 249 and the stem 204A and a ring exteriorly and circumferentially defined thereon to prevent fluid communication between the terminal 249 and the cone 202.

As pressure is received within the chamber 204A', the piston 204 is shifted upwardly. As the slips of the tubing hanger H encounter the wall of the casing C, the ratchet teeth 247 are co-engaged with the ratchet teeth 248 on the terminal 249, thus positively locking the piston 204 to the terminal 249 to maintain the piston 204 in its uppermost position in the latch cone 202 subsequent thereto.

The latch cone 202 also receives a tubing extension 254 communicating to the tubing strings T-4 and T-2, the extension 254 being secured at threads 255 to the cone 202.

Lefthand Acme threads 253 secure the lock housing 205 to the latch cone 202 and are rotationally utilized in conjunction with the emergency release ring 207 in the event that hydraulic unlatching of the latch assembly 200 is not possible and it is desired to mechanically unlatch the latch assembly 200 from the tubing hanger H.

MAKE-UP OF TUBING HANGER ASSEMBLY

Now referring to FIGS. 1 amd 2, when it is desired to run the space-out section 100A and the lower section 100B into the hole in one trip, the component parts of the assembly 100 are made up at the surface of the well with the upper tubing string T-3 being secured through one side of the split surface hanger SSH. The string T-3 typically may carry a rotational adjustment sub RAS, a shear-out safety joint 400 spaced somewhat therebelow, a wireline or tubing mounted safety valve SV, an optional swivel sub 300 below the safety valve SV, a latch assembly L secured to the lowermost end of the tubing string T-3, and the tubing hanger H therebelow. The lower tubing string T-1 is affixed through the lowermost end of the hanger H for fluid communication with the tubing string T-3 thereabove, the tubing string T-1 carrying somewhat below the tubing hanger H a seal nipple SN having a bypass plug means SNP engaged therein permitting upward flow of fluid through the lower end of the tubing string T-1 and preventing downward flow of fluid therethrough. A packer P-1 may be carried on the end of the tubing string T-1 with the lower open end of the tubing T-1 extending through and below the packer P-1 and communicating with the zone Z-1. Alternatively, the packer P-1 may be initially set by auxiliary work string or the like, and the end of the tubing string T-1 stabbed into the packer P-1.

The bypass plug SNP may be left out of the nipple SN, if the tubing hanger H is to be set by the control or setting tool.

The tubing string T-4 is affixed to the other side of the split surface hanger SSH and typically may carry thereon a rotational adjustment sub RAS, a shear-out safety joint 400 therebelow, a tubing or wireline mounted safety valve SV, a latch assembly L, and a tubing hanger H. The lower tubing string T-2 is affixed through the lowermost end of the hanger H and also will carry a seal nipple SN and a bypass plug SNP therein. The packer P-2 may be carried or set as described for the packer P-1.

It should be noted that the bypass plugs SNP may be utilized in applying fluid pressure to the piston element for the setting of the tubing hanger H, as an alternate to utilization of a setting tool 600 in conjunction with the latch assembly 500 or as an alternate to utilization of the control tool 203 to set the tubing hanger H with the latch assembly 200. Also, the bypass plugs are utilized in the seal nipple SN to control the fluids in the well W through the tubing strings T-1 and T-2 below the hanger H subsequent to unlatching of the latch assembly L. The plugs prevent flow of fluids from the interior of the tubing string through the bottom open end thereof, but permit fluid to enter the open end and pass within the tubing during running of the assembly to the desired location in the well W.

SETTING OF THE TUBING HANGER WITH LATCH ASSEMBLY 500

After the assembly 100 is made up, it is run into the well W and each of the packers P-1 and P-2 may be set above their respective zone Z-1 and Z-2. Fluid is circulated down the tubing strings and upwardly in the tubing-casing annulus, and around the packers. Thereafter, the packers P-1 and P-2 may be set.

If it is desired to set the latch assembly 500 with the setting tool 600, the assembly 100 is run into the well W with the setting tool 600 carried on the locking tool LT and the locking tool LT is locked into the lock housing 510 by means of the locking profiles 540A and 540B receiving the dogs of the locking tool LT, as shown in FIG. 6. In this position, the port 608 of the setting tool 600 is transversely aligned with the port 512A in the latch cone 504.

In order to activate the hydraulic setting of the tubing hanger H, the ball 610 is permitted to gravitate or is pumped through the tubing string T-4 through the inner housing 502 and through the outer body 601 of the setting tool 600, until it is sealingly landed upon the ball seat 609 of the ball sleeve 607. Now, the lower end of the port 608 in the outer body 601 of the setting tool 600 is plugged, and permits fluid to pass thereacross and into the port 512A of the latch cone 504, thence through the port passage 512 defined transversely across the latch cone 504 and into the piston chamber 514 below the sliding piston 513 by means of the port 512B in the latch cone 504. As pressure is increased, the pressure will act across the piston chamber 514 below the ring 526 to urge the piston 513 upwardly, the piston 513 in turn carrying the hanger mandrel HM which is shear pinned to the hanger slip mandrel connector 518 at the lower end of the sliding piston 13. As the sliding piston 513 continues upward travel within the latch cone 504, the ratchet teeth 517A on the hanger slip mandrel connector 518 will ratchetly secure within the body lock ring 516 on the ratchet teeth 517 thereof. Thus, the sliding piston 513 is locked in its uppermost position and the slips of the tubing hanger H have been anchoringly engaged into the inner wall of the casing C.

During longitudinal shifting of the sliding piston 513 and manipulation of the slips outwardly onto the wall of the casing C, the shear strength of the shear pin 519 securing the hanger mandrel HM to the slip mandrel connector 518 has been overcome and shears, thus separating the hanger mandrel HM from the sliding piston 513. The tubing hanger H now has been completely set.

Just prior to setting the tubing hanger H, it is necessary to elevate the split surface hanger SSH a slight but calculated distance above the bowl SHB. When the tubing hanger H is set and weight is slacked off the tubing strings, the hanger SSH will land in the bowl SHB, and the calculated distance will be defined between the ends of the collet fingers and the guide surface 11A, to permit initial relative movement between the latch cone and the collet fingers during unlatching, described below.

Circulation now may be established by increasing pressure, which will be increased to exceed the shear strength of the shear pin 604 locking the sleeve 607 to the sleeve housing 602. The sleeve 607 will shift downwardly within the interior of the sleeve housing 602 until further downward travel is prevented by the interface of the lower end of the sleeve 607 onto the shoulder 611 of the sleeve housing 602. Now, the port 612 in the outer body 601 of the setting tool communicates with the exterior of the setting tool 600. The setting tool 600 and the locking tool LT are removed from the tubing string T-4 by means of wireline tool (now shown).

The space-out section 100A is spaced out and the split surface hanger SSH is caused to be lowered into the surface hanger bowl SHB. Thereafter, a wireline tool (not shown) is run through the tubing string T-3 and secured to the control mandrel 409 of the shear-out safety joint 400 at the fishing neck 410. The control mandrel 409 is shifted upwardly the distance "D" such that the shoulder 418 thereon contacts and bypasses the shoulder 417 of the collet 414. The bevel 416 on the collet mandrel 409 is moved simultaneously upwardly and somewhat away from the shoulder 415B of the finger 415 of the collet 414. Upward travel of the collet 409 subsequent to the upper shoulder 419 of the collet support 412 contacting the engaging shoulder 417 of the collet 414 will cause the finger 415 to "pop" out of the upper collet profile 405, and simultaneously also cause the finger 413 to shift out of the lower collet profile 407. The control mandrel 409, with the collet 414, is completely retrieved from the interior of the shear-out safety joint 400 and the tubing string T-3. Now, the bridge across the inner housing 404 to the outer housing 401 has been removed, thus relaxing the weight load carrying capability of the shear-out safety joint 400, and it now may carry only the weight load defined across the shear pin 402. In the event that this weight load is exceeded for any reason, either intentionally or unintentionally, the shear pin 402 will shear, thus separating the inner housing 404 which may be carried upwardly with the tubing string T-3, while the outer housing 401 will remain affixed to and in communication with the bottom portion of the tubing string T-3. The safety valve SV therebelow should be in the closed position, if the control tubing normally affixed to the tubing string T-3 or T-4 is severed, thus isolating well fluids in the tubing strint T-3 therebelow.

UNLATCHING OF LATCH ASSEMBLY 500 AND THE HANGER H

In the event of seal or other damage to any of the component parts of the space-out section 100 which would necessitate retrieval of the space-out section 100 to the surface of the well W to the platform PP for repair, the latch assembly 500 may be hydraulically released from the tubing hanger H by running the wireline manipulated locking tool LT with the control tool 544 into the well W.

Prior to running of the control tool 544, the control tool 544 has been armed for unlatching of the collet fingers 523 from within the tubing hanger guide 11 by plugging the port 546A with the seal plug 546A' and by plugging the port 548A in the lowermost portion of the housing 545 with the seal plug 548A'.

Figure 9A:
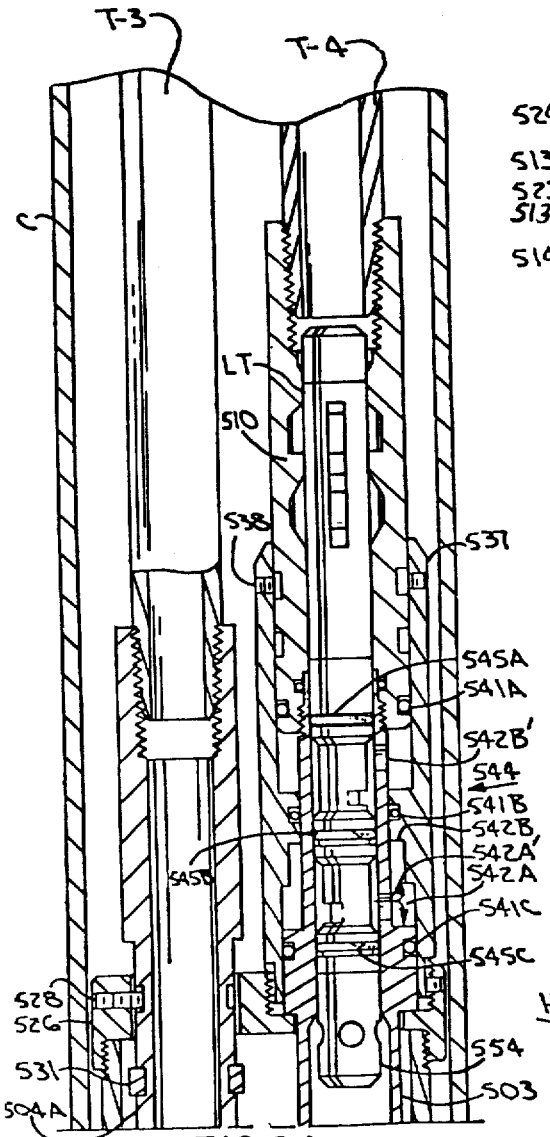
FIGS. 9A, 9B and 9C together constitute a view of the control tool within the latch assembly armed for unlatching of the latch assembly relative to the set tubing hanger for retrieval of the space-out section to the top of the well.
Figure 9B:
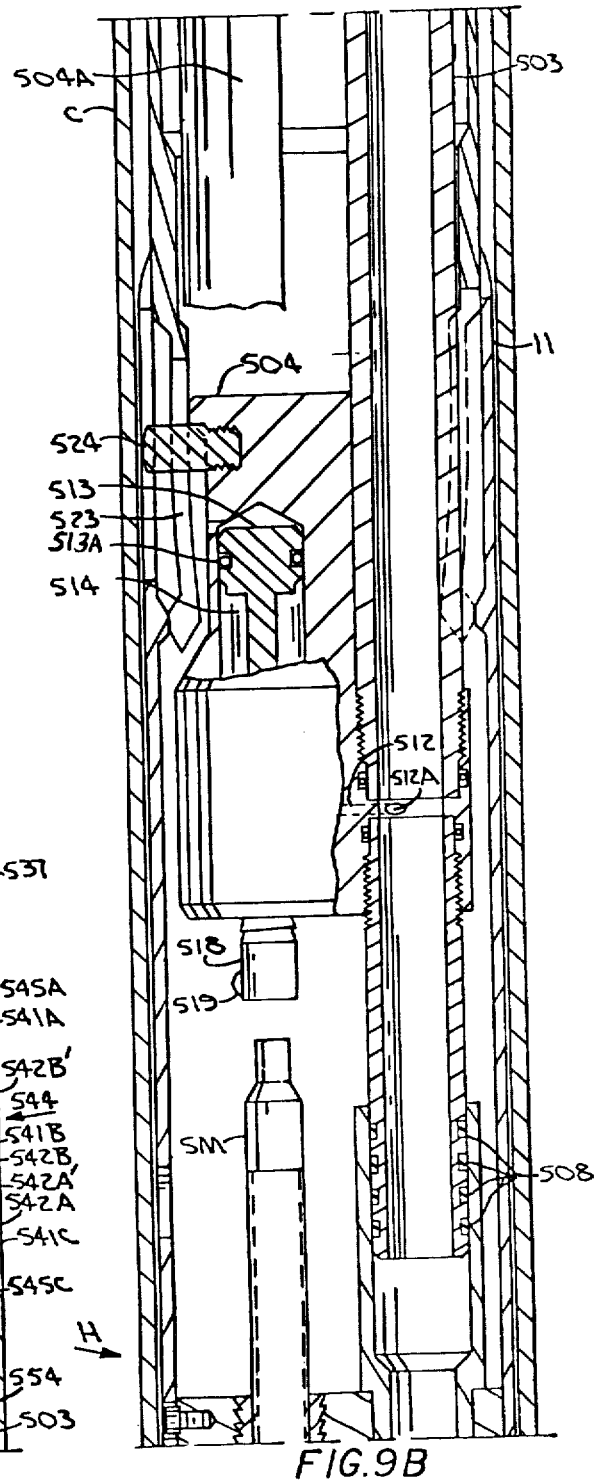
Figure 9C:
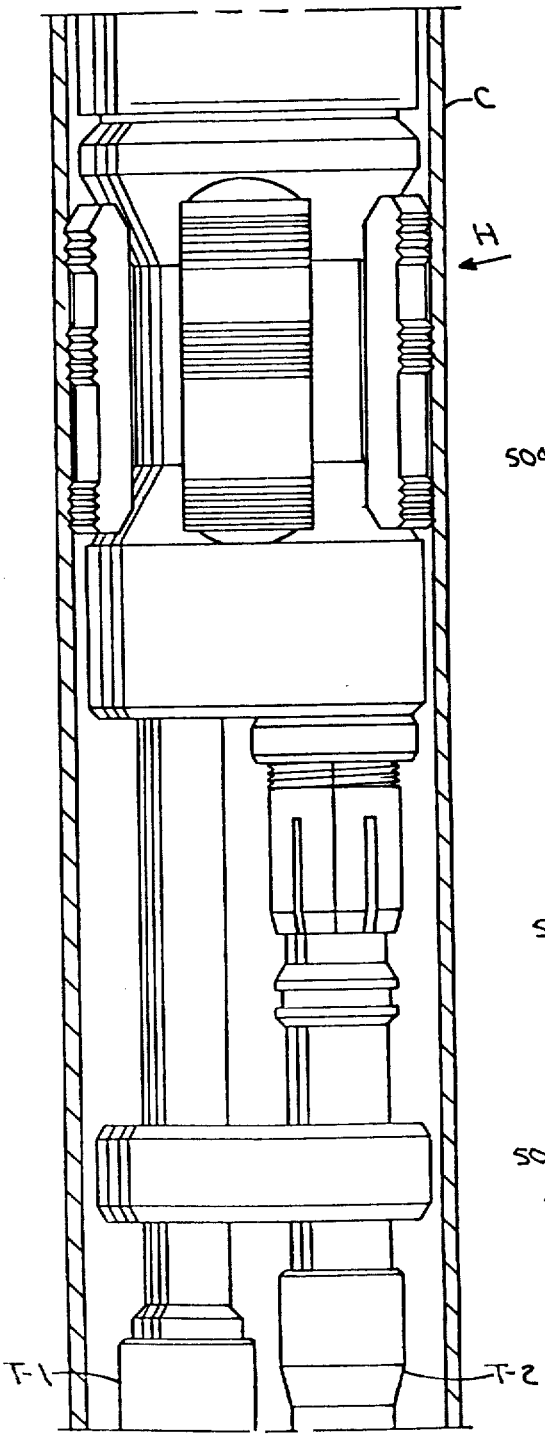
Figure 10A:
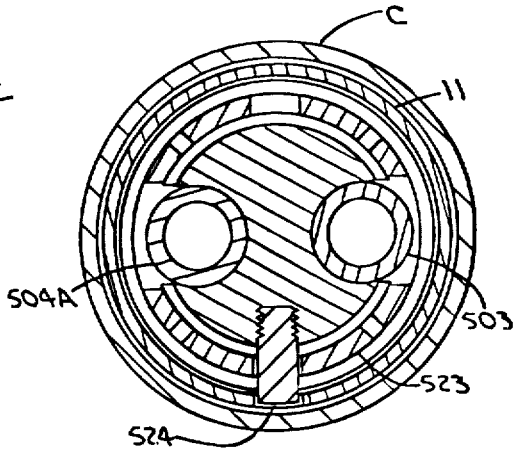
FIG. 10A is a cross-sectional view taken along line 10A—10A of FIG. 5B.
Figure 10B:
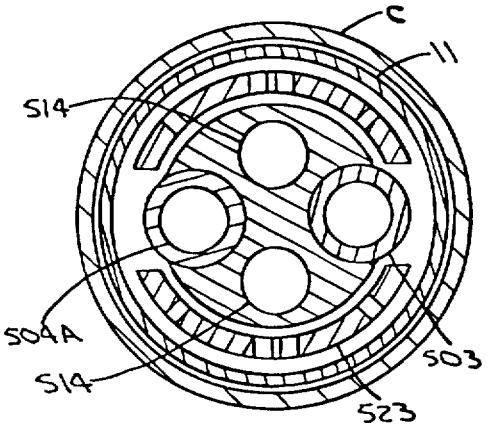
FIG. 10B is a cross-sectional view taken along line 10B—10B of FIG. 5B.
Figure 10C:
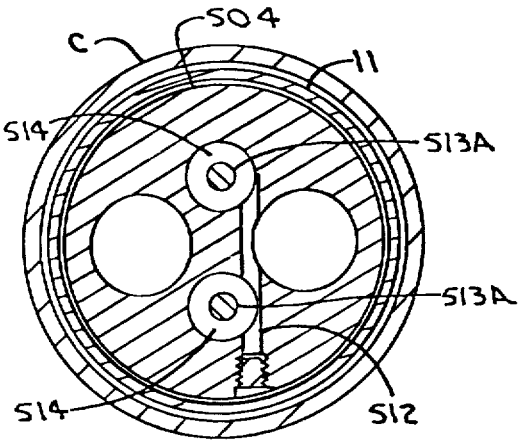
FIG. 10C is a cross-sectional view taken along line 10C—10C of FIG. 5B.

Referring to FIGS. 9A, 9B and 9C, the locking tool LT is shown run in the tubing string T-4 with the control tool 544 attached to the lower end thereof, until such time as the dogs of the locking tool LT are lockingly engaged within the locking profiles 540A and 540B on the lock housing 510. In this position, the rings 545B and 545C on the housing 545 of the control tool 544 bridge the port 542A' to the chamber 542A, and the rings 545B and 545A correspondingly bridge the port 542B'. Now, referring to FIG. 9A, fluid may pass from within the housing 545 through the port 546B into the chamber 542A to activate the piston 542B of the piston mandrel 537, with fluid being vented from the chamber 542C above the piston 542B through the port 542B', thence through the passage 547 and exteriorly of the housing 545 through the port 547A, and then exterior of the control tool 544 through the port 555.

After the control tool 544 has been landed in place, as described above, the ball 553 is pumped or gravitated down through the tubing string T-4 and is sealingly engaged upon the seal 552 of the seat mandrel 549. Pressure is increased and passes through the port 546B into the chamber 542A, acting on the ring 541B on the piston 542 to move the piston mandrel 537 upwardly relative to the mandrel 543. Correspondingly, as the piston mandrel 537 is urged upwardly, the mandrel 503 is urged downwardly, carrying the latch cone 504 therewith. As the piston mandrel 537 moves upwardly, it carries the fingers 523 therewith. The relative separation movement, as defined, now enables the fingers 523 of the collet to be removed from the shoulder 520 of the latch cone 504 and the beveled shoulder 11A of the tubing hanger guide 11, thus separating the latch assembly 500 from the tubing hanger H. Now, the tubing strings T-3 and T-4 may be removed from the well carrying the space-out section 100A, and leaving the lower section 100B in place, with the bypass plugs within the seating nipples SN controlling the well within the tubing strings T-1 and T-2 below the hanger H.

RELATCHING OF SPACE-OUT SECTION AND THE TUBING HANGER UTILIZING THE LATCH ASSEMBLY 500

Referring to FIGS. 8A, 8B, 8C, 8D and 11, when it is desired to rerun the space-out section 100A into the well W for sealing and latching engagement within the tubing hanger assembly 100B, the control tool 544 again is landed in place within the mandrel 503, as described for the initial latching procedure. However, prior to running the space-out section 100A into the well W, the control tool 544 is re-armed for the relatching procedure by removing the plug 546A' to the port 546A, plugging the port 546B with the seal plug 546B', removing the plug 548A' within the port 548A and plugging the port 547A with the seal plug 547A'. Now, pressure may be applied to the chamber 542C to shift the piston 542B downwardly, with pressure being vented thereunder in the chamber 542A through the passage 548 and out of the port 548A, thence through the port 555 and out of the control tool 544.

The ball 553 again is gravitated or pumped through the tubing string T-4 until it lands on the ball seat 552 on the seal mandrel 549. Pressure is increased and is communicated through the port 546A in the housing 545 through the port 542B' and into the chamber 542C to act upon the piston 542B above the seal 545B to shift the piston mandrel 537 and the fingers 523 downwardly. As downward movement is thus applied, the mandrel 503 and its interconnecting parts are relatively urged upwardly, together with the latch cone 504, such that the fingers 523 are now interlocked between the guide 11 and the latch cone 504 with the collet shoulder 522 held in place along the guide shoulder 11A of the guide 11 and the collet end 521 is stationed upon the shoulder 520 of the latch cone 504. Now, the latch assembly 500 is engaged to the guide 11 and the space-out section 100A is again in sealing engagement with the tubing hanger assembly 100B therebelow. Pressure may be increased within the tubing string T-4 to shear the shear pin 550 to disengage the seat mandrel 549 from the housing 545. As the seat mandrel 549 is captured by the cage 554 therebelow, fluid pressure escapes through the control tool 544 through the port 548A in the cage 554, for circulating fluids down the tubing string T-4 and T-2 and through the annular area between the tubing strings and the casing C.

Alternatively, rather than increase pressure to shear the seat mandrel 549, the control tool 544 and the locking tool LT simply may be retrieved by wireline to the top of the well and out of the tubing string T-4, prior to establishing circulation.

UNLATCHING OF THE LATCH ASSEMBLY 500 FROM THE TUBING HANGER BY MECHANICAL MEANS

In the event that the latch assembly 500 cannot be disengaged from the tubing hanger H by applying pressure through the tubing string, as described above, the latch assembly 500 may be mechanically disengaged from the tubing hanger H by rotating either of the tubing strings T-3 and T-4, but preferably the non-control string T-3. This rotational movement may be effected by rotating the complete tubing string or strings below the split surface hanger SSH, or above the surface hanger SSH, if the hanger SSH has a gland-type penetration for the tubing. Alternatively, one or more of the tubing strings may be rotated below the swivel sub 300 by utilization of an auxiliary work string to the end of which is affixed the actuator 301 for manipulation of the swivel sub 300.

Figure 21:
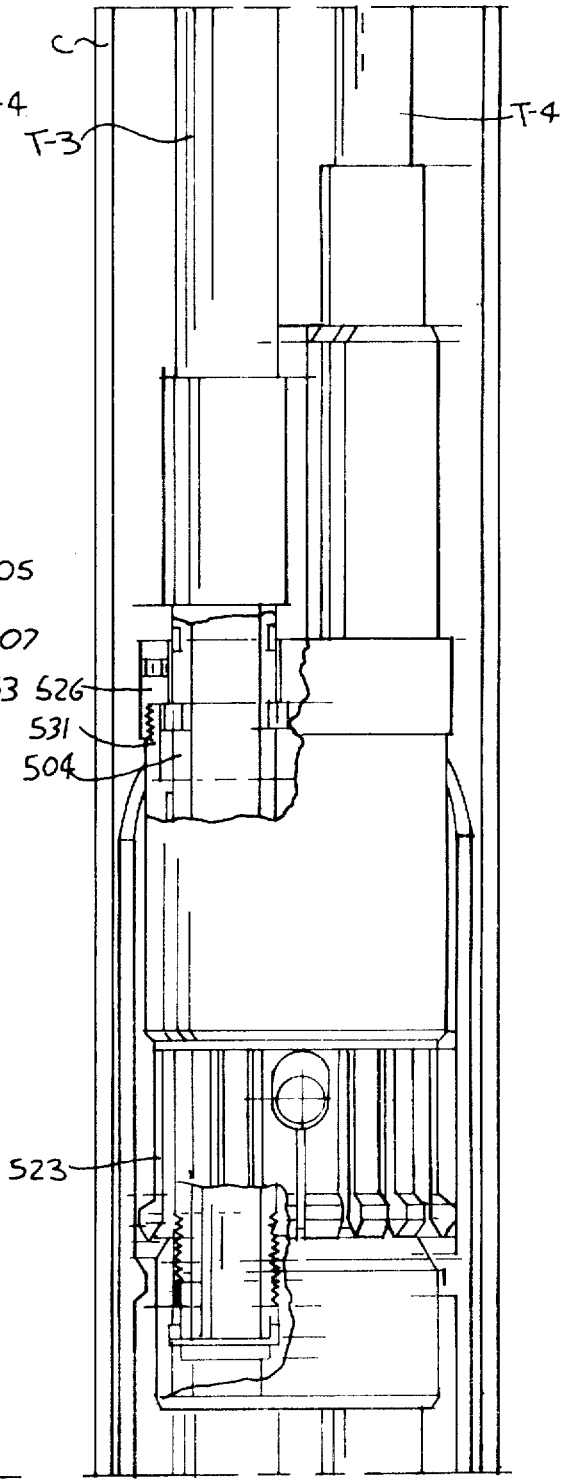
FIG. 21 is a view similar to that of FIG. 20 showing the emergency mechanical release of the latch assembly and the tubing hanger.
Figure 23A:
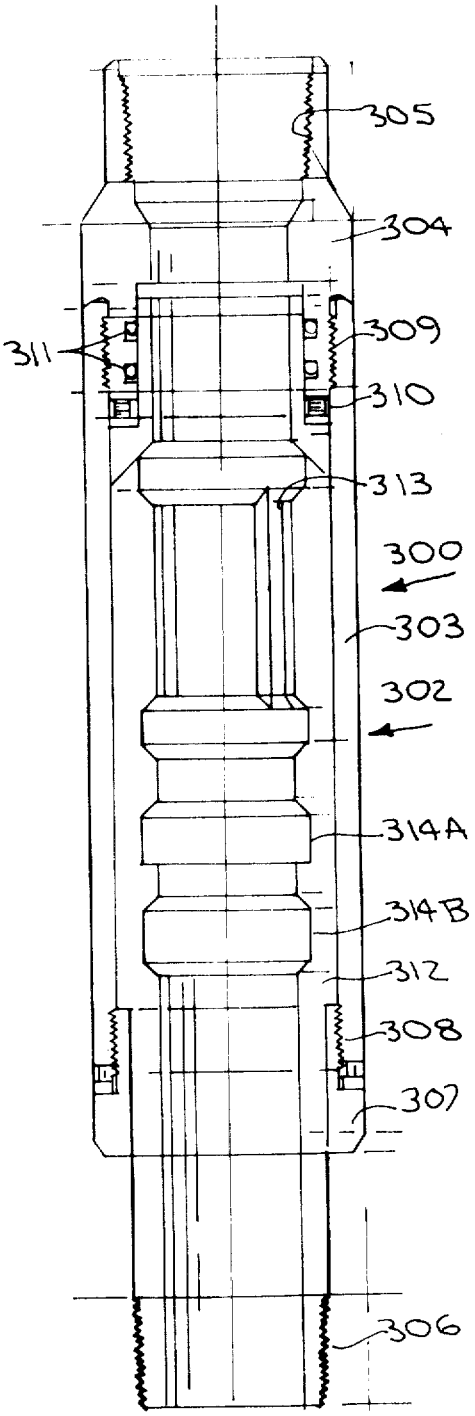
FIG. 23A is a longitudinal view of the swivel sub or tubing rotation apparatus for incorporation in the present invention.
Figure 23B:
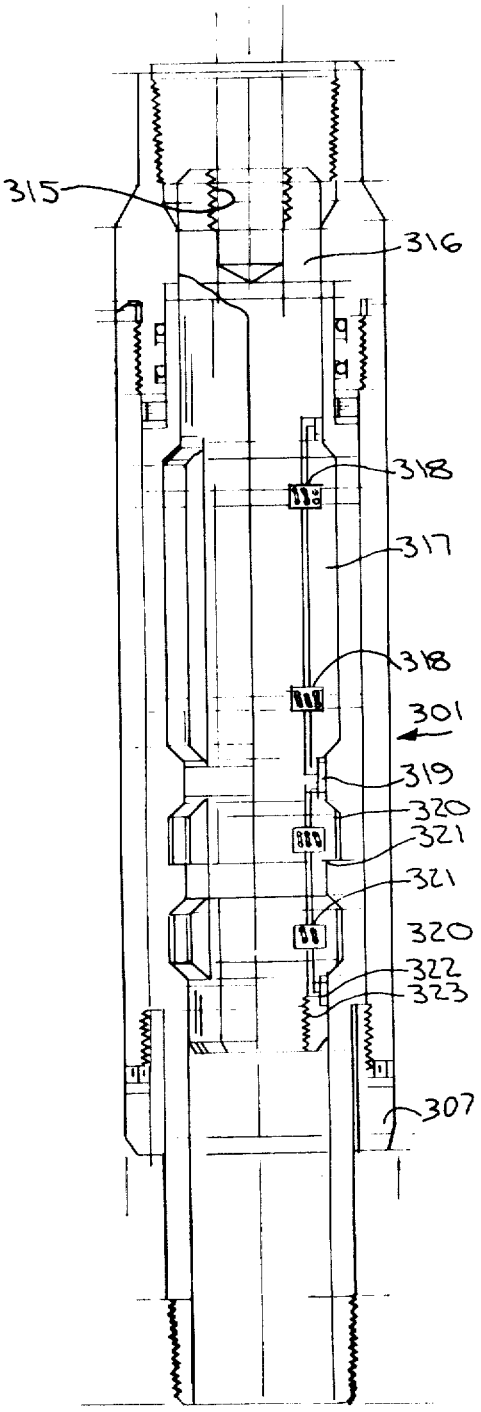
FIG. 23B is an illustration of the actuator means incorporated within the housing of the swivel joint and rotationally interengaged therewith.

Referring to FIGS. 21, 23A and 23B, assuming that it is desired to rotate the tubing string T-3 by activation of the swivel sub 300, the auxiliary work string (not shown) is inserted through the tubing string T-3 and the actuator is carried at its lowermost end. The actuator 301 is inserted within the swivel sub housing 302 until the travel resistors 320 are landed within the limiting grooves 314A and 314B. At such time, the rotational dogs 317 are urged outwardly by the springs 318 toward the splines 313 on the spline mandrel 312. In the event that the dogs 317 are not interengaged between the splines 313, they may be rotationally interaligned therewith by slight application of righthand rotation. Upon such rotation, the dogs 317 will fall into the splines 313 and the righthand rotation may be transmitted from the actuator 301 and the auxiliary work string to the spline mandrel 312 and thence to the lower portion of the tubing string T-3.

As the tubing string is rotated to the right, the lefthand Acme threads 505 are separated, thus urging the mandrel extension 504A up and the latch cone 504 downwardly, and moving the emergency mechanical release ring 531 up to interface with the lower shoulder 532A of the latch control ring 526. As the mechanical release ring 531 moves relatively toward the shoulder 532A, the shear pin 528 is sheared. Upon interface of the ring 531 with the shoulder 532A downward movement of the latch cone 504 and the latch cone 504 is resisted and the collet fingers 523 are urged upwardly, thus disengaging the fingers 523 from the locked engagement between the hanger guide 11 and the latch cone 504.

Now, the collet fingers 523 are completely disengaged from the latch cone 504, and the space-out section 100A may be retrieved to the top of the well, leaving the lower section 100B in place, with the bypass plugs in the seating nipples SN again controlling the well therebelow.

SETTING OF THE TUBING HANGER USING LATCH ASSEMBLY 200

Figure 14:
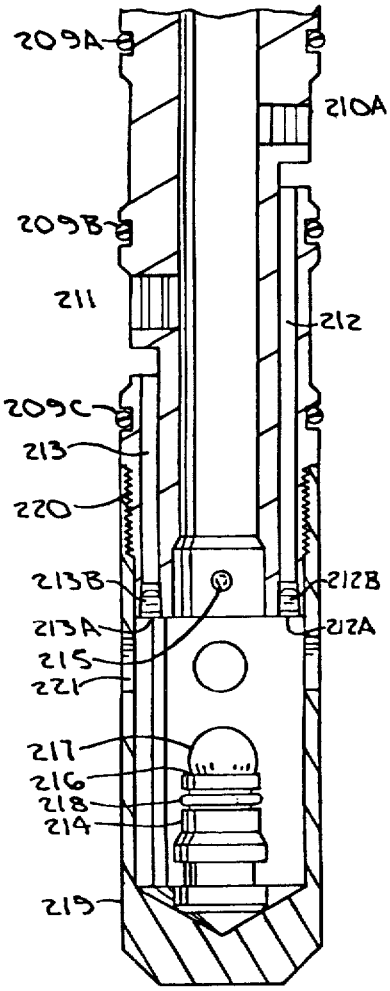
FIG. 14 is a view similar to that of FIGS. 12 and 13, illustrating the control tool armed for initial setting of the alternative latch assembly, the view also illustrating a ball seat shear sleeve in the control tool in released position for circulation of fluids through and out of the control tool, subsequent to setting of the tubing hanger.

Referring to FIGS. 14, 16 and 17, subsequent to the setting of the packers P-1 above the zone Z-1 and the setting of the packer P-2 above the zone Z-2, the tubing hanger H is set by applying fluid pressure through the tubing string T-4 and into the control tool 203. Prior to running of the apparatus 100 into the well W, the control tool 203 has been armed for setting of the tubing hanger H by inserting seal plug 212B within port 212A and seal plug 213B within threaded port 213A. Ports 210 and 211 are not plugged. After locating the assembly 100 at the proper depth in the well W, the ball 217 is permitted to gravitate or is pumped through the tubing string T-4 into the control tool 203 through the cylindrical body 209 until it is sealingly engaged upon the seat 216 of the ball shear-out sleeve 214. As pressure is increased, it will be applied from the control tool 203 through the open port 211 to the passage 213, thence within the cone 202 through the port 223B, the passage portions 223A–223D and into the chamber 204A' through the port 223E. As pressure is increased within the chamber 204A', the piston 204 will be urged upwardly within the cone 202 carrying the piston stem 204A and urging the hanger mandrel HM longitudinally upwardly to shift the slips outwardly and away from the body of the tubing hanger H into anchoring engagement upon the inner surface of the casing C, at which time the ratchet teeth 247 on the hanger slip mandrel connector 245 have become interengaged with the companion ratchet teeth 248 carried on the piston terminal 249 to prevent further longitudinal shifting of the piston 204.

During the setting procedure, it should be noted that fluid pressure has been permitted to also pass through the passage portion 223A into the chamber 224A by means of the port 223C, but the piston 224 is not shifted because pressure within each of the chambers 224A and 224B is equalized because fluid pressure also is permitted to pass exterior of the cylindrical body 209 through the port 210 through the passage 212, thence into the latch cone 202 through the port 228B, the passage 228A and into the chamber 224B through the port 228C.

After the setting of the tubing hanger H, fluid pressure is increased within the tubing string T-4 until such time as the shear pin 215 engaging the ball shear-out sleeve 214 to the cylindrical body 209 is overcome, thus causing the sleeve 214 to be shifted downwardly and held within the cage 219. Now, circulation may be established between the tubing strings T-4 and T-2 and fluid is permitted to pass through the port 221 of the cage 219. Alternatively, fluid communication between the tubing strings T-4 and T-2 may be established without increasing pressure and shearing the pin 215 holding the sleeve 214 in place merely by retrieving the control tool 203 by wireline manipulation.

Just prior to setting the tubing hanger H, it is necessary to elevate the split surface hanger SSH a slight but calculated distance above the bowl SHB. When the tubing hanger H is set and weight is slacked off the tubing strings, the hanger SSH will land in the bowl SHB, and the calculated distance will be defined between the ends of the collet fingers and the guide surface 11A, to permit initial relative movement between the latch cone and the collet fingers during unlatching, described below.

UNLATCHING OF THE UPPER TUBING SECTION FROM THE TUBING HANGER USING THE LATCH ASSEMBLY 200

In the event of seal or other damage to one of the component parts of the space-out system 100A, thus necessitating retrieval of the space-out section 100A to the platform PP of the well, the control tool 203 again is run through the tubing string T-4 on wireline with the control tool 203 being locked into the profiles 205A and 205B of the lock housing 205. As shown in FIGS. 14 and 17, the control tool 203 has been redressed by shear pinning the sleeve 214 to the body 209 (assuming that the sleeve 214 has been caused to be released from the body 209, as described above), and by arming the control tool 203 for unlatching of the space-out section 100A from the tubing hanger H by securing the seal plug 210A in the port 210, and plugging the port 213A with the plug 213B. The ball 217 is gravitated or pumped through the tubing string T-4 through the cylindrical body 209 of the control tool 203 until it is sealingly engaged upon the seat 216. Pressure then is increased within the tubing string T-4 and is applied through the open port 211 to the latch cone 202 through the port 223 and the passage 223A, the fluid pressure passing through the port 223C and into the chamber 224A below the piston 224. Pressure also is enabled to pass through the passage portion 223D and outwardly thereof through the port 223E into the chamber 204A below the piston 204. However, because the piston 204 is in its uppermost position and also is ratchetly secured to the lock ring 248A by the interface of the teeth 248-247, such fluid pressure communication to the chamber 204A' does not adversely affect the upward shifting of the piston 224.

As pressure is increased within the chamber 224, the piston 224 moves upwardly. Also, pressure is vented out of the chamber 224B through the port 228C and its interconnecting fluid flow passages. Since the shoulder screw 230 is secured within the piston 224 and the screw 230, in turn, carries the fingers 240, the shear strength of the pin 233 will be overcome and will shear, thus enabling the piston 224 to continue further upward longitudinal movement carrying the fingers 240. As pressure is increased and the piston 224 is moved, weight is applied on one or more of the tubing strings T-3 and T-4, and is transmitted through the latch cone 202. Now, there is relative movement between the latch cone 202 and the finger 240, the latch cone 202 being urged downwardly and the fingers 240 being urged upwardly. When the shoulder screw 230 moves upwardly the distance "A", the shoulder 242A of the latch cone 202 has moved away from the bevel 242B of the spoon 241 and the interface between the latch abutment 11A and the shoulder 242 have been removed, enabling the spoon 241 to travel upwardly and over the latch abutment 11A, thus freeing the collet fingers 240 from the latch cone 202. Now, the space-out section 100A may be retrieved from the lower section 100B, leaving the lower section 100B in place with the bypass plugs SNP in the seal nipples SN in the tubing strings T-1 and T-2 below the tubing hanger H for controlling the well W.

RELATCHING OF THE UPPER SECTION TO THE TUBING HANGER USING THE LATCH ASSEMBLY 200

After repair has been completed to a defective component defined within the space-out section 100A, the space-out section 100A may be rerun into the well W with the control tool 203 rearmed for relatching of the latch assembly 200 into the tubing hanger H for sealing and mechanical engagement of the space-out section 100A to the lower section 100B. The collet fingers 240 are held in an uppermost position relative to the latch cone 202 and are engaged to the cone 202 in this position by inserting another shear pin 233 into the upper groove 232B on the cone 202. Now, the piston 224 is held in its uppermost position in the cone 202. Now, it will be desired to urge the piston 224 downwardly and, in turn, the collet fingers 240, relative to slight upward movement of the latch cone 202 to latch the assembly 200 into the hanger guide 11 of the tubing hanger H.

Referring to FIG. 18, to effect downward longitudinal piston movement, the port 210 in the body 209 remains open, while the port 212A is plugged with the seal plug 212B, and the port 211 receives the seal plug 211A. The port 213A remains open for venting of the chamber 224A below the piston 224 through the port 223C, thence the passage 223A, to the port 223B in the cone 202, thence through the longitudinally extending passage 213 to the open port 213A.

Now, the ball 217 is again gravitated or pumped through the tubing string T-4 through the cylindrical body 209 until it is sealingly rested upon the seat 216 of the ball shear-out sleeve 214. Pressure then may be increased within the tubing string T-4 and will pass out of the body 209 by means of the port 210 into the passage 212, thence through the latch cone 202 by means of the port 228B and through the transverse passage 228A into the chamber 224B above the piston 224.

As pressure is increased within the chamber 224B, the shear strength of the pin 233 in the groove 232B will be overcome and the collet 201 will be shearingly disengaged with respect to the cone 202, thus enabling the piston 224 to be shifted downwardly the distance "A". As pressure is applied through the tubing string T-4 and into the chamber 224B to move the piston 224 downwardly together with the collet 201, relative movement is effected between the collet 201 and the latch cone 202. Now, the collet 201 is moved downwardly, thus interfacing the bevel 242B to the shoulder 242A. Now, the spoon 241 on the lowermost end of the finger 240 is interfaced between the guide 11 and the cone 202 such that longitudinal movement upward of the guide 11 and the latch cone 202 is limited by the guide abutment 11A to the shoulder 242. The latch assembly 200 is engaged to the tubing hanger H in this fashion, and the space-out section 100A again is engaged to the lower section 100B. Thereafter, pressure may be increased within the tubing string T-4 to cause the shear pin 215 holding the sleeve 214 in place on the body 209 to be overcome, thus shifting the sleeve 214 downwardly out of the body 209 and into the cage 219 to provide fluid communication from the body 209 through the port 221 of the cage 219, as described above. Alternatively, before pressure is increased after relatching of the latch assembly 200 of the hanger H, the control tool 203 simply may be removed from the tubing string T-4 by retrieval by wireline tool.

MECHANICAL UNLATCHING OF THE UPPER SECTION FROM THE TUBING HANGER USING THE LATCH ASSEMBLY 200

If for any reason, such as failure of seals or the like, it is not possible to apply fluid pressure to the piston 224 to unlatch the latch assembly 200 from the hanger H, such unlatching may be effected by mechanical means. Referring to FIGS. 21, 23A and 23B, one or more of the tubing strings T-3 and T-4 are rotated to the right. Such righthand rotation may be effected through the entire tubing strings extending from the surface hanger SSH. Alternatively, when such rotation is not practical or possible because, for example, of the positioning of the split surface hanger SSH into the bowl SHB, an auxiliary work string (not shown) may be inserted into one of the tubing strings T-3 and T-4 with the actuator 301 of the swivel sub assembly 300 affixed to the lowermost end thereof. As the auxiliary work string passes downwardly through the tubing string, the travel resistors 320 will pass through the swivel sub housing 302 and will become engaged within the respective limiting grooves 314A and 314B of the swivel sub housing 302. Concurrently, the rotational dogs 317 on the actuator 301 will become longitudinally aligned with the splines 313 and interengaged therewith. In the event that the dogs 317 and splines 313 are not interengaged, slight righthand rotation of the auxiliary work string will urge the dogs 317 into the splines 313 by the outward urging of the dogs 317 by the springs 318. Now, the spline mandrel 312 is interengaged with the actuator 301 and righthand rotation of the auxiliary work string may be transmitted to the spline mandrel 312 and to the lower portion of the tubing string to the latch assembly 200.

Regardless of the method of rotating one or more of the tubing strings T-3 and T-4, righthand rotation thereof will cause the lefthand Acme threads 253 on the lower end of the lock housing 205 and the upper end of the latch cone 202 to begin initial separation. This initial separation of the threads 253 will shift the emergency release ring 207, longitudinally upwardly until such time as further travel is prevented by interface of the ring 207 with the abutment 201B on the collet 201. Concurrently, righthand rotation of the threads 253 will also shift the latch cone 202 downwardly and since the guide 11, spoon 241 and cone 202 still are interengaged, the cone 202 will be urged downwardly relative to the collet 201, the force defined by the relative motion therebetween ultimately overcoming the strength of the shear pin 233 and enabling it to shear, thus releasing the collet 201 from the latch cone 202. Accordingly, the fingers 240 now may be moved upwardly as righthand rotation is continued, relative to the latch cone 202, and the spoon 241 of the finger 240 will become disengaged between the guide 11 of the hanger H and the latch cone 202. As the righthand rotation is continued, the threads 253 will completely part, and since the collet 201 is disengaged from the guide 11, the space-out section 100A will become disengaged from the lower section 100B.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. An apparatus for producing a well from plural productive zones penetrated by the well bore in which casing is set below the top of the well, said apparatus comprising: tubing hanger means supporting a plurality of lower production tubing string sections extending downwardly in the well bore and respectively communicating with one of said productive zones; anchor means on said tubing hanger means activatable into anchoring engagement with said casing; plural upper production tubing string sections received in said hanger means and extending to the top of the well and sealingly engaged within said tubing hanger means before, during, and after the anchoring engagement of said tubing hanger means with said casing; a latch apparatus carried on and extending between said upper production tubing string sections for initial securement of said tubing hanger means to each of said upper production tubing string sections and for unlatching of said upper production tubing sections from said hanger means, the sum of the weight of said tubing hanger means and each of said lower production tubing string sections, carriable by said latch apparatus prior to anchoring said tubing hanger means with said casing, whereby said upper production tubing string sections are respectively communicable with said downwardly extending production tubing string sections when the tubing hanger is set for production of the well.

2. The apparatus of claim 1 further comprising plural safety valve means carried on said upper production tubing string sections for selective isolation of production fluids in said sections therebelow.

3. The apparatus of claim 2 further comprising: control fluid conduit means leading from each of said safety valves to the top of the well and connectable to a source of control fluid pressure to manipulate said safety valve means between open and closed positions to selectively control well fluid flow through said upper production tubing sections.

4. The apparatus of claims 1, 2 or 3 further comprising: means for transmitting fluid pressure through said apparatus to shift said tubing hanger means into anchoring engagement with said casing.

5. The apparatus of claims 1, 2 or 3 further comprising seal nipple means carried on at least one of said lower production tubing string sections below said hanger means; and bypass plug means insertable within said seal nipple means to permit fluid flow upwardly through said lower production tubing string section and to prevent fluid flow downwardly through the lower end of said lower production tubing string section of the exterior thereof.

6. The apparatus of claim 4 wherein the means for transmitting fluid pressure comprises seal nipple means carried on at least one of said lower production tubing string sections below said hanger means; and bypass plug means insertable within said seal nipple means to permit fluid flow upwardly through said lower production tubing string section and to prevent fluid flow downwardly through the lower end of said lower production tubing string section to the exterior thereof, to shift said tubing hanger means into anchoring engagement with said casing upon application of fluid pressure from the top of the well through said upper and lower production tubing string sections.

7. The apparatus of claim 4 wherein said fluid pressure transmitting means comprises: setting tool means carried through and within one of said upper production tubing string sections for transmitting fluid pressure from at least one of said upper production tubing string sections to said hanger means to activate said anchor means into anchoring engagement with said casing.

8. The apparatus of claim 1: said latching means having a piston housing and a piston element longitudinally shiftable therein and selectively engageable with said anchor means to shift said anchor means into engagement with said casing.

9. The apparatus of claim 1 wherein said latch apparatus comprises means for hydraulically releasing said upper production tubing string sections from said tubing hanger means and for hydraulically re-engaging said sections with said tubing hanger means.

10. The apparatus of claim 9 further comprising means for mechanically shifting said latch apparatus relative to said tubing hanger means to release said upper string sections from said hanger means.

11. The apparatus of claim 1 wherein said latch apparatus comprises: an outer housing and an inner body; latching means carried on one of said housing and said body for selectively securing said latch apparatus to said tubing hanger means; latch engaging means carried on said tubing hanger means and on the other of said housing and said body for selective co-engagement between said latching means, said tubing hanger means and said one of said housing and said body.

12. The apparatus of claim 1 wherein said latch apparatus comprises: an outer housing and an inner body; latching means carried on one of said housing and said body for selectively securing said latch apparatus to said tubing hanger means; latch engaging means carried on said tubing hanger means and on the other of said housing and said body for selective co-engagement between said latching means, said tubing hanger means and said one of said housing and said body; and piston means on one of said housing and said body of said latch assembly and having a piston head shiftable in one direction upon application of fluid pressure to shift said anchoring means into anchoring engagement with said casing.

13. The apparatus of claim 1 wherein said latch apparatus comprises: an outer housing and an inner body; latching means carried on one of said housing and said body for selectively securing said latch apparatus to said tubing hanger means; latch engaging means carried on said tubing hanger means and on the other of said housing and said body for selective co-engagement between said latching means, said tubing hanger means and said one of said housing and said body; piston means on one of said housing and said body and having a piston head; first and second piston chambers between said piston head; control means removable from said latch apparatus to direct fluid pressure transmitted through at least one of said upper production tubing string sections to said latch apparatus and having passageways to selectively provide a first fluid flow path within said control means and said latch apparatus to one of said upper and lower piston chambers to shift said housing and said body relative to one another to release said latching means from said tubing hanger means, said control means having passageways selectively providing a second fluid flow path therethrough to the other of said upper and lower piston chambers to shift said housing and said body relative to one another to selectively engage said latching means to said tubing hanger means.

14. The apparatus of claim 13 wherein said removable control means is manipulated within said latch apparatus by means communicating to wireline extending to the top of the well through at least one of said upper production tubing string sections.

15. The apparatus of claim 13 further comprising: longitudinal travel resisting means carried between said body and said housing of said latch apparatus; and means on at least one of said body and said housing of said latch apparatus and communicable to at least one of said upper production tubing string sections to transmit tubing string rotation to longitudinally shift said travel resisting means to travel resisting position to effect relative movement between said body and said housing of said latch apparatus for release of said latch apparatus from said tubing hanger means.

16. The apparatus of claims 13 or 15 further comprising: second piston means on said body communicable to means on said tubing hanger means for shifting said anchoring means of said tubing hanger means in one direction to anchor said tubing hanger means with said casing; means defining a fluid conduit through said body of said latch apparatus to said second piston means and communicating to one of said upper and lower piston chambers whereby when one of said first and second fluid flow paths is established in said control means, fluid flow is transmitted in said fluid conduit means to said second piston means to shift said second piston means in said one direction to anchor said tubing hanger means with said casing.

17. The apparatus of claim 1 further comprising swivel means carried on at least one of said upper production tubing string sections, said tubing string sections having an upper tubing portion extendible from above said swivel means to the top of the well and a lower tubing portion extendible from and below said swivel means, said swivel means being manipulatable to rotate said lower tubing portion without rotating said upper tubing portion, said swivel means comprising: first and second housings, one of said housings and said lower tubing portion being rotatable relative to the other of said housings; actuator means insertable within at least one of said housings for applying rotation to one of said housings; and co-engaging means carried on said actuator means and one of said housings for applying rotational force to one of said housings and said lower tubing portion to rotate said one housing and said lower tubing portion without rotating the other of said housing and said upper tubing portion.

18. The apparatus of claim 17 wherein the co-engaging means comprises at least one spline on one of said actuator means and one of said housings; and at least one spline dog means carried on and outwardly urged away from the other of said actuator means and the one of said housings.

19. The apparatus of claim 18 wherein plural spline dog means are carried on and outwardly urged away from the actuator means; and plural splines are on one of said housings.

20. The apparatus of claim 17 wherein said actuator means is manipulatable by an auxiliary work string insertable through said upper tubular portion.

21. The apparatus of claim 1 further comprising shear-out safety means connectable on at least one of said upper production tubing string sections, said shear-out safety means being selectively separatable whereby said production tubing string section may be parted, comprising: first means selectively retrievable from said shear-out safety means for carrying across said shear-out safety means a first weight load defined through said production tubing string section below said shear-out safety means; and second weight load carrying means for carrying across said shear-out safety means a second weight load defined through said production tubing string section below said shear-out safety means, said second weight load being less than said first weight load, said second means being activatable to separate said shear-out safety means and said upper production tubing string section when said second weight load is exceeded.

22. The apparatus of claim 21 wherein said first weight load is at least equal to the weight of the tubing string below said shear-out safety means.

23. The apparatus of claim 21 wherein said first weight load is substantially equal to the weight of the tubing string below said shear-out safety means.

24. The apparatus of claim 21 wherein said first means is extendible in said shear-out safety means and comprises a collet selectively held on said shear-out safety means by a mandrel means, said collet being disengageable from said shear-out safety means upon manipulation of said mandrel.

25. The apparatus of claim 24 wherein said mandrel is longitudinally shiftable to disengage said collet from said shear-out safety means.

26. The apparatus of claim 25 wherein said mandrel is longitudinally shiftable by means carried on wireline and extendible through said upper production tubing string section.

27. The apparatus of claim 21 wherein said second weight load carrying means comprises shear pin means initially engaged through said shear-out safety means and selectively shearable thereacross.

28. The apparatus of claim 13 wherein the control means comprises: a cylindrical housing; means defining first and second selectively pluggable fluid ports in said cylindrical housing, one of said ports communicable with the first piston chamber and the other of said port communicable with the second piston chamber; first and second selectively pluggable fluid vent passageways through said cylindrical housing, one of said vent passageways being communicable to one of said piston chambers and the other of said vent passageways being communicable to the other of said piston chambers; and seal plug means insertable within one of said fluid ports and within one of said vent passageways to establish said first fluid flow path to direct fluid pressure to one of said chambers and vent fluid from the other chamber to shift said piston in the first direction, said seal plug means being insertable within the other of said fluid ports and the other of said vent passgeways to establish said second fluid flow path to direct fluid passage to the other of said chambers and vent fluid from another of said chambers to shift said piston in a second direction.

29. The apparatus of claim 28 further comprising valve seat means below said ports and within said cylindrical body for receipt of valve head means to selectively seal the lower end of said cylindrical housing.

30. The apparatus of claim 29 wherein said valve head means is a spherical element insertable through one of said upper production tubing string sections onto said valve seat.

31. The apparatus of claim 29 wherein said valve seat means is shearably releasable from and initially carried on said cylindrical housing and is shiftable in a direction to a position to permit fluid flow through said cylindrical housing and downwardly therethrough.

32. The apparatus of claim 1: said latching means having hydraulic means to shift said anchor means into engagement with said casing.

33. The apparatus of claim 13 further comprising means to shift said housing and said body relative to one another to release said latching means from said tubing hanger means when one of the upper production tubing string sections is rotated.

34. An apparatus for producing a well from at least one production zone penetrated by the well bore in which casing is set below the top of the well, said apparatus comprising: tubing hanger means supporting at least one lower production tubing string section extending downwardly in the well bore and communicating with at least one productive zone; anchor means on said tubing hanger means activatable into anchoring engagement with said casing; at least one upper production tubing string section received in said hanger means and extending to the top of the well and sealingly engaged within said tubing hanger means before, during and after the anchoring engagement of said tubing hanger means with said casing; a latch apparatus carried on said upper production tubing string section for initial securement of said tubing hanger means to said upper production tubing string section and for unlatching of said upper production tubing string section from said hanger means, the sum of the weight of said tubing hanger means and said lower production tubing string section carriable by said latch apparatus prior to anchoring said tubing hanger means with said casing, whereby said upper production tubing string section is communicable with said downwardly extending production tubing string section when the tubing hanger is set for production of the well; seal nipple means carried on said lower production tubing string section below said hanger means; and bypass plug means insertable within said seal nipple means to permit fluid flow upwardly through said lower production tubing string section and to prevent fluid flow downwardly through the lower end of said lower production tubing string section to the exterior thereof.

35. The apparatus of claim 34 further comprising safety valve means carried on said upper production tubing string section for selective isolation of production fluids in said section therebelow.

36. The apparatus of claim 35 further comprising: control fluid conduit means leading from said safety valve means to the top of the well and connectable to a source of control fluid pressure to manipulate said safety valve means between open and closed positions to selectively control well fluid flow through said upper production tubing string section.

37. The apparatus of claims 34, 35 or 36 further comprising: means for transmitting fluid pressure through said apparatus to shift said tubing hanger means into anchoring engagement with said casing.

38. The apparatus of claim 37 wherein the means for transmitting fluid pressure comprises seal nipple means carried on said lower production tubing string section below said hanger means; and bypass plug means insertable within said seal nipple means to permit fluid flow upwardly through said lower production tubing string section and to prevent fluid flow downwardly through the lower end of said lower production tubing string section to the exterior thereof, to shift said tubing hanger means into anchoring engagement with said casing upon application of fluid pressure from the top of the well through said upper and lower production tubing string sections.

39. An apparatus for producing a well from at least one productive zone penetrated by the well bore in which casing is set below the top of the well, said apparatus comprising: tubing hanger means supporting at least one lower production tubing string section extending downwardly in the well bore and communicating with at least one productive zone; anchor means on said tubing hanger means activatable into anchoring engagement with said casing; at least one upper production tubing string section received in said hanger means and extending to the top of the well and sealingly engaged within said tubing hanger means before, during and after the anchoring engagement of said tubing hanger means with said casing; a latch apparatus carried on said upper production tubing string section for initial securement of said tubing hanger means to said upper production tubing string section and for unlatching of said upper production tubing string section from said hanger means, the sum of the weight of said tubing hanger means and said lower production tubing string section carriable by said latch apparatus prior to anchoring said tubing hanger means with said casing, whereby said upper production tubing string section is communicable with said downwardly extending production tubing string section when the tubing hanger is set for production of the well; and means for transmitting fluid pressure through said apparatus to shift said tubing hanger means into anchoring engagement with said casing, said fluid pressure transmitting means comprising: setting tool means carried through and within said upper production tubing string section for transmitting fluid pressure from said upper production tubing string section to said hanger means to activate said anchor means into anchoring engagement with said casing.

40. An apparatus for producing a well from at least one productive zone penetrated by the well bore in which casing is set below the top of the well, said apparatus comprising: tubing hanger means supporting at least one lower production tubing string section extending downwardly in the well bore and communicating with at least one productive zone; anchor means on said tubing hanger means activatable into anchoring engagement with said casing; at least one upper production tubing string section received in said hanger means and extending to the top of the well and sealingly engaged within said tubing hanger means before, during and after the anchoring engagement of said tubing hanger means with said casing; a latch apparatus carried on said upper production tubing string section for initial securement of said tubing hanger means to said upper production tubing string section and for unlatching of said upper production tubing string section from said hanger means, the sum of the weight of said tubing hanger means and said lower production tubing string section carriable by said latch apparatus prior to anchoring said tubing hanger means with said casing, whereby said upper production tubing string section is communicable with said downwardly extending production tubing string section when the tubing hanger is set for production of the well latch apparatus having a piston housing and a piston element longitudinally shiftable therein and selectively engageable with said anchor means to shift said anchor means into engagement with said casing.

41. The apparatus of claim 34: said latching means having hydraulic means to shift said anchor means into engagement with said casing.

42. An apparatus for producing a well from at least one productive zone penetrated by the well bore in which casing is set below the top of the well, said apparatus comprising: tubing hanger means supporting at least one production tubing string section extending downwardly in the well bore and communicating with at least one productive zone; anchor means on said tubing hanger means activatable into anchoring engagement with said casing; at least one upper production tubing string section received in said hanger means and extending to the top of the well and sealingly engaged within said tubing hanger means before, during and after the anchoring engagement of said tubing hanger means with said casing; a latch apparatus carried on said upper production tubing string section for initial securement of said tubing hanger means to said upper production tubing string section and for unlatching of said upper production tubing string section from said hanger means, the sum of the weight of said tubing hanger means and said lower production tubing string section carriable by said latch apparatus prior to anchoring said tubing hanger means with said casing, whereby said upper production tubing string section is communicable with said downwardly extending production tubing string section when the tubing hanger is set for production of the well said latch apparatus comprising: means for hydraulically releasing said upper production tubing string section from said tubing hanger means and for hydraulically re-engaging said section with said tubing hanger means.

43. The apparatus of claim 42 further comprising means for mechanically shifting said latch apparatus relative to said tubing hanger means to release said upper string section from said hanger means.

44. An apparatus for producing a well from at least one productive zone penetrated by the well bore in which casing is set below the top of the well, said apparatus comprising: tubing hanger means supporting at least one lower production tubing string section extending downwardly in the well bore and communicating with at least one productive zone; anchor means on said tubing hanger means activatable into anchoring engagement with said casing; at least one upper production tubing string section received in said hanger means and extending to the top of the well and sealingly engaged within said tubing hanger means before, during and after the anchoring engagement of said tubing hanger means with said casing; a latch apparatus carried on said upper production tubing string section for initial securement of said tubing hanger means to said upper production tubing string section and for unlatching of said upper production tubing string section from said hanger means, the sum of the weight of said tubing hanger means and said lower production tubing string section carriable by said latch apparatus prior to anchoring said tubing hanger means with said casing, whereby said upper production tubing string section is communicable with said downwardly extending production tubing string section when the tubing hanger is set for production of the well, said latch apparatus comprising: an outer housing and an inner body; latching means carried on one of said housing and said body for selectively securing said latch apparatus to said tubing hanger means; latch engaging means carried on tubing hanger means and on the other of said housing and said body for selective co-engagement between said latching means, said tubing hanger means and said one of said housing and said body.

45. An apparatus for producing a well from at least one productive zone penetrated by the well bore in which casing is set below the top of the well, said apparatus comprising: tubing hanger means supporting at least one lower production tubing string section extending downwardly in the well bore and communicating with at least one productive zone; anchor means on said tubing hanger means activatable into anchoring engagement with said casing; at least one upper production tubing string section received in said hanger means and extending to the top of the well and sealingly engaged within said tubing hanger means before, during and after the anchoring engagement of said tubing hanger means with said casing; a latch apparatus carried on said upper production tubing string section for initial securement of said tubing hanger means to said upper production tubing string section and for unlatching of said upper production tubing string section from said hanger means, the sum of the weight of said tubing hanger means and said lower production tubing string section carriable by said latch apparatus prior to anchoring said tubing hanger means with said casing, whereby said upper production tubing string section is communicable with said downwardly extending production tubing string section when the tubing hanger is set for production of the well, said latch apparatus comprising: an outer housing and an inner body; latching means carried on one of said housing and said body for selectively securing said latch apparatus to said tubing hanger means; latch engaging means carried on said tubing hanger means and on the other of said housing and said body for selective co-engagement between said latching means, said tubing hanger means and said one of said housing and said body; and piston means on one of said housing and said body of said latch assembly and having a piston head shiftable in one direction upon application of fluid pressure to shift said anchoring means into anchoring engagement with said casing.

46. An apparatus for producing a well from at least one productive zone penetrated by the well bore in which casing is set below the top of the well, said apparatus comprising: tubing hanger means supporting at least one lower production tubing string section extending downwardly in the well bore and communicating with at least one productive zone; anchor means on said tubing hanger means activatable into anchoring engagement with said casing; at least one upper production tubing string section received in said hanger means and extending to the top of the well and sealingly engaged within said tubing hanger means before, during and after the anchoring engagement of said tubing hanger means with said casing; a latch apparatus carried on said upper production tubing string section for initial securement of said tubing hanger means to said upper production tubing string section and for unlatching of said upper production tubing string section from said hanger means, the sum of the weight of said tubing hanger means and said lower production tubing string section carriable by said latch apparatus prior to anchoring said tubing hanger means with said casing, whereby said upper production tubing string section is communicable with said downwardly extending production tubing string section when the tubing hanger is set for production of the well, said latch apparatus comprising: an outer housing and an inner body; latching means carried on one of said housing and said body for selectively securing said latch apparatus to said tubing hanger means; latch engaging means carried on said tubing hanger means and on the other of said housing and said body for selective co-engagement between said latching means, said tubing hanger means and said one of said housing and said body; piston means on one of said housing and said body and having a piston head; first and second piston chambers between said piston head; control means removable from said latch apparatus to direct fluid pressure transmitted through at least one of said upper production tubing string sections to said latch apparatus and having passageways to selectively provide a first fluid flow path within said control means and said latch apparatus to one of said upper and lower piston chambers to shift said housing and said body relative to one another to release said latching means from said tubing hanger means, said control means having passageways selectively providing a second fluid flow path therethrough to the other of said upper and lower piston chambers to shift said housing and said body relative to one another to selectively engage said latching means to said tubing hanger means.

47. The apparatus of claim 46 further comprising means to shift said housing and said body relative to one another to release said latching means from said tubing hanger means when said upper production tubing string section is rotated.

48. The apparatus of claim 46 wherein said removable control means is manipulated within said latch apparatus by means communicating to wire line extending to the top of the well through said upper production tubing string section.

49. The apparatus of claim 46 further comprising: longitudinal travel resisting means carried between said body and said housing of said latch apparatus; and means on at least one of said body and said housing of said latch apparatus and communicable to said upper production tubing string section to transmit tubing string rotation to longitudinally shift said travel resisting means to travel resisting position to effect relative movement between said body and said housing of said latch apparatus for release of said latch apparatus from said tubing hanger means.

50. The apparatus of claim 46 or 48 further comprising: second piston means on said body communicable to means on said tubing hanger means for shifting said anchoring means of said tubing hanger means in one direction to anchor said tubing hanger means with said casing; means defining a fluid conduit through said body of said latch apparatus to said second piston means and communicating to one of said upper and lower piston chambers whereby when one of said first and second fluid flow paths is established in said control means, fluid flow is transmitted in said fluid conduit means to said second piston means to shift said second piston means in said one direction to anchor said tubing hanger means with said casing.

51. The apparatus of claim 46 wherein the control means comprises: a cylindrical housing; means defining first and second selectively pluggable fluid ports in said cylindrical housing, one of said ports communicable with the first piston chamber and the other said port communicable with the second piston chamber; first and second selectively pluggable fluid vent passageways through said cylindrical housing, one of said vent passageways being communicable to one of said piston chambers and the other of said vent passageways being communicable to the other of said piston chambers; and seal plug means insertable within one of said fluid ports and within one of said vent passageways to establish said first fluid flow path to direct fluid pressure to one of said chambers and vent fluid from the other chamber to shift said piston in the first direction, said seal plug means being insertable within the other of said fluid ports and the other of said vent passageways to establish said second fluid flow path to direct fluid passage to the other of said chambers and vent fluid from another of said chambers to shift said piston in a second direction.

52. The apparatus of claim 51 further comprising valve seat means below said ports and within said cylindrical body for receipt of valve head means to selectively seal the lower end of said cylindrical housing.

53. The apparatus of claim 52 wherein said valve head means is a spherical element insertable through one of said upper production tubing string sections onto said valve seat.

54. The apparatus of claim 52 wherein said valve seat means is shearably releaseable from and initially carried on said cylindrical housing and is shiftable in a direction to a position to permit fluid flow through said cylindrical housing and downwardly therethrough.

55. An apparatus for producing a well from at least one productive zone penetrated by the well bore in which casing is set below the top of the well, said apparatus comprising: tubing hanger means supporting at least one lower production tubing string section extending downwardly in the well bore and communicating with at least one productive zone; anchor means on said tubing hanger means activatable into anchoring engagement with said casing; at least one upper production tubing string section received in said hanger means and extending to the top of the well and sealingly engaged within said tubing hanger means before, during and after the anchoring engagement of said tubing hanger means with said casing; a latch apparatus carried on said upper production tubing string section for initial securement of said tubing hanger means to said upper production tubing string section and for unlatching of said upper production tubing string section from said hanger means, the sum of the weight of said tubing hanger means and said lower production tubing string section carriable by said latch apparatus prior to anchoring said tubing hanger means with said casing, whereby said upper production tubing string section is communicable with said downwardly extending production tubing string section when the tubing hanger is set for production of the well; swivel means carried on said upper production tubing string section, said upper tubing string section having an upper tubing portion extendible from above said swivel means to the top of the well and a lower tubing portion extendible from and below said swivel means, said swivel means being manipulatable to rotate said lower tubing portion without rotating said upper tubing portion, said swivel means comprising: first and second housings, one of said housings and said lower tubing portions being rotatable relative to the other of said housing; actuator means insertable within at least one of said housings for applying rotation to one of said housings; and co-engaging means carried on said actuator means and one of said housings for applying rotational force to one of said housings and said lower tubing portion to rotate said one housing and said lower tubing portion without rotating the other of said housing and said upper tubing portion.

56. The apparatus of claim 55 wherein the co-engaging means comprises at least one spline on one of said actuator means and one of said housings; and at least one spline dog means carried on and outwardly urged away from the other of said actuator means and the one of said housings.

57. The apparatus of claim 56 wherein plural spline dog means are carried on and outwardly urged away from the actuator means; and plural splines are on one of said housings.

58. The apparatus of claim 55 wherein said actuator means is manipulatable by an auxiliary work string insertable through said upper tubular portion.

59. An apparatus for producing a well from at least one productive zone penetrated by the well bore in which casing is set below the top of the well, said apparatus comprising: tubing hanger means supporting at least one lower production tubing string section extending downwardly in the well bore and communicating with at least one productive zone; anchor means on said tubing hanger means activatable into anchoring engagement with said casing; at least one upper production tubing string section received in said hanger means and extending to the top of the well and sealingly engaged within said tubing hanger means before, during and after the anchoring engagement of said tubing hanger means with said casing; a latch apparatus carried on said upper production tubing string section for initial securement of said tubing hanger means to said upper production tubing string section and for unlatching of said upper production tubing string section from said hanger means, the sum of the weight of said tubing hanger means and said lower production tubing string section carriable by said latch apparatus prior to anchoring said tubing hanger means with said casing, whereby said upper production tubing string section is communicable with said downwardly extending production tubing string section when the tubing hanger is set for production of the well; shear-out safety means connectable on said upper production tubing string section, said shear-out safety means being selectively separatable whereby said production tubing string section may be parted, comprising: first means selectively retrievable from said shear-out safety means for carrying across said shear-out safety means a first weight load defined through said production tubing string section below said shear-out safety means; and second weight load carrying means for carrying across said shear-out safety means a second weight load defined through said production tubing string section below said shear-out safety means, said second weight load being less than said first weight load, said second means being activatable to separate said shear-out safety means and said upper production tubing string section when said second weight load is exceeded.

60. The apparatus of claim 59 wherein said first weight load is at least equal to the weight of the tubing string below said shear-out safety means.

61. The apparatus of claim 59 wherein said first weight load is substantially equal to the weight of the tubing string below said shear-out safety means.

62. The apparatus of claim 59 wherein said first means is extendible in said shear-out safety means and comprises a collet selectively held on said shear-out safety means by a mandrel means, said collet being disengageable from said shear-out safety means upon manipulation of said mandrel.

63. The apparatus of claim 59 wherein said mandrel is longitudinally shiftable to disengage said collet from said shear-out safety means.

64. The apparatus of claim 63 wherein said mandrel is longitudinally shiftable by means carried on wire line and extendible through said upper production tubing string section.

65. The apparatus of claim 59 wherein said second weight load carrying means comprises shear pin means initially engaged through said shear-out safety means and selectively shearable thereacross.

* * * * *